US010423088B1

(12) United States Patent
Sugawara et al.

(10) Patent No.: US 10,423,088 B1
(45) Date of Patent: Sep. 24, 2019

(54) ELECTROSTATIC CHARGE IMAGE DEVELOPING TONER, ELECTROSTATIC CHARGE IMAGE DEVELOPER, AND TONER CARTRIDGE

(71) Applicant: FUJI XEROX CO., LTD., Tokyo (JP)

(72) Inventors: Atsushi Sugawara, Kanagawa (JP); Sakiko Hirai, Kanagawa (JP); Yasuo Kadokura, Kanagawa (JP); Daisuke Tomita, Kanagawa (JP); Satoshi Miura, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 16/117,060

(22) Filed: Aug. 30, 2018

(30) Foreign Application Priority Data

Apr. 16, 2018 (JP) ..... 2018-078565
Apr. 16, 2018 (JP) ..... 2018-078566

(51) Int. Cl.
*G03G 9/087* (2006.01)
*G03G 15/08* (2006.01)
*G03G 9/08* (2006.01)

(52) U.S. Cl.
CPC ..... *G03G 9/08711* (2013.01); *G03G 9/0819* (2013.01); *G03G 9/0821* (2013.01); *G03G 9/08782* (2013.01); *G03G 9/08795* (2013.01); *G03G 15/0865* (2013.01)

(58) Field of Classification Search
CPC ..... G03G 9/08711; G03G 9/08795; G03G 9/0821; G03G 9/08782
See application file for complete search history.

(56) References Cited

U.S. PATENT DOCUMENTS 6,495,648 B1 * 12/2002 Inagaki ..... G03G 9/08711 428/402
6,733,938 B1 5/2004 Ninomiya et al.
6,803,166 B2 * 10/2004 Cheng ..... C08K 5/0008 430/137.14

FOREIGN PATENT DOCUMENTS

JP 08-220803 A 8/1996
JP 2001-201887 A 7/2001

* cited by examiner

*Primary Examiner* — Janis L Dote
(74) *Attorney, Agent, or Firm* — Sughrue Mion, PLLC

(57) ABSTRACT

An electrostatic charge image developing toner includes a styrene-acrylic resin and exhibits a z average molecular weight Mz of 80,000 to 400,000 and a molecular weight distribution curve satisfying Expression (1): $1.3 \leq b/a \leq 2.0$, and an electrostatic charge image developing toner includes a styrene-acrylic resin, and exhibits a z average molecular weight Mz of 100,000 to 400,000 and a molecular weight distribution curve satisfying Expression (A): $0.75 \leq (c+d)/(2 \times d) \leq 0.95$, wherein a, b, c and d are defined in the specification.

14 Claims, 4 Drawing Sheets

ELECTROSTATIC CHARGE IMAGE DEVELOPING TONER, ELECTROSTATIC CHARGE IMAGE DEVELOPER, AND TONER CARTRIDGE

CROSS-REFERENCE TO RELATED APPLICATIONS

This application is based on and claims priority under 35 USC 119 from Japanese Patent Application No. 2018-078565 filed on Apr. 16, 2018 and Japanese Patent Application No. 2018-078566 filed on Apr. 16, 2018.

BACKGROUND

(i) Technical Field

The present invention relates to an electrostatic charge image developing toner, an electrostatic charge image developer, and a toner cartridge.

(ii) Related Art

In an image forming apparatus, a toner image formed on an image holding member is transferred onto a surface of a recording medium and the toner image is fixed on the recording medium by a fixing member which contacts the toner image to cause heating, pressurizing, or the like, thereby forming an image.

For example, JP-A-2001-201887 discloses an electrostatic charge image developing toner including at least a binder resin, a colorant, and a wax, in which, regarding a molecular weight of a THF soluble component of the toner obtained by GPC, a proportion of a molecular weight of $5\times10^5$ or more in integral molecular weight distribution is 1% by weight or less, a proportion of a molecular weight of $3\times10^3$ or less in the integral molecular weight distribution is 30% by weight or less, and a ratio $\{W(5\times10^3)/W(1\times10^5)\}$ of a proportion of a molecular weight of $5\times10^3$ or less in the integral molecular weight distribution $\{W(5\times10^3)\}$ to a proportion of a molecular weight of $1\times10^5$ or more in the integral molecular weight distribution $\{W(1\times10^5)\}$ is from 15 to 50.

In addition, JP-A-8-220803 discloses a method of producing a styrene copolymer for a toner, the method including, adding a vinyl monomer mixture including a vinyl monomer including two or more unconjugated double bonds into a dispersion formed by dispersing a styrene polymer having a weight average molecular weight of 5,000 to 20,000, to allow suspension polymerization, and a method of producing a toner including, molten-kneading at least the styrene copolymer for a toner obtained by the producing method described above and a colorant, and cooling, pulverizing and classifying the molten-kneaded material.

SUMMARY

Aspects of non-limiting embodiments of the present disclosure relate to an electrostatic charge image developing toner in which occurrence of a difference in glossiness of images before and after repeatedly forming high-density images is prevented, as compared with a case where a z average molecular weight Mz is less than 80,000 or more than 400.000 or in a case where the following b/a of a molecular weight distribution curve described later is less than 1.3 or more than 2.0, with respect to an electrostatic charge image developing toner including a styrene-acrylic resin, which corresponds to the following first aspect of the present disclosure, and an electrostatic charge image developing toner in which occurrence of a difference in glossiness on images formed on thin paper before and after repeatedly forming images on thick paper is prevented, as compared with a case where a z average molecular weight Mz is less than 100,000 or more than 400,000 or in a case where the following (c+d)/(2× d) of a molecular weight distribution curve described later is less than 0.75 or more than 0.95, with respect to an electrostatic charge image developing toner including a styrene-acrylic resin, which corresponds to the following second aspect of the present disclosure.

Aspects of certain non-limiting embodiments of the present disclosure overcome the above disadvantages and other disadvantages not described above. However, aspects of the non-limiting embodiments are not required to overcome the disadvantages described above, and aspects of the non-limiting embodiments of the present disclosure may not overcome any of the problems described above.

According to a first aspect of the present disclosure, there is provided an electrostatic charge image developing toner including:

a styrene-acrylic resin, wherein the electrostatic charge image developing toner exhibits a z average molecular weight Mz of 80.000 to 400,000, and a molecular weight distribution curve satisfying Expression (1):

$$1.3 \le b/a \le 2.0 \qquad \text{Expression (1)}$$

(in Expression (1), a represents a width on a high molecular weight side from a perpendicular line at a height which is 50% of a height of a maximum peak, in a case where the perpendicular line is drawn down from the maximum peak of the molecular weight distribution curve, and b represents a width on a high molecular weight side from a perpendicular line at a height which is 15% of a height of the maximum peak, in a case where the perpendicular line is drawn down from the maximum peak of the molecular weight distribution curve).

According to a second aspect of the present disclosure, there is provided an electrostatic charge image developing toner including:

a styrene-acrylic resin, wherein the electrostatic charge image developing toner exhibits a z average molecular weight Mz is 100,000 to 400,000, and a molecular weight distribution curve satisfying Expression (A):

$$0.75 \le (c+d)/(2\times d) \le 0.95 \qquad \text{Expression (A)}$$

(in Expression (A), c represents a width on a low molecular weight side from a perpendicular line at a height which is 50% of a height of a maximum peak, in a case where the perpendicular line is drawn down from the maximum peak of the molecular weight distribution curve, and d represents a width on a high molecular weight side from a perpendicular line at a height which is 50% of a height of the maximum peak, in a case where the perpendicular line is drawn down from the maximum peak of the molecular weight distribution curve).

BRIEF DESCRIPTION OF THE DRAWINGS

Exemplary embodiments of the present invention will be described in detail based on the following figures, wherein.

DETAILED DESCRIPTION

Figure 1:
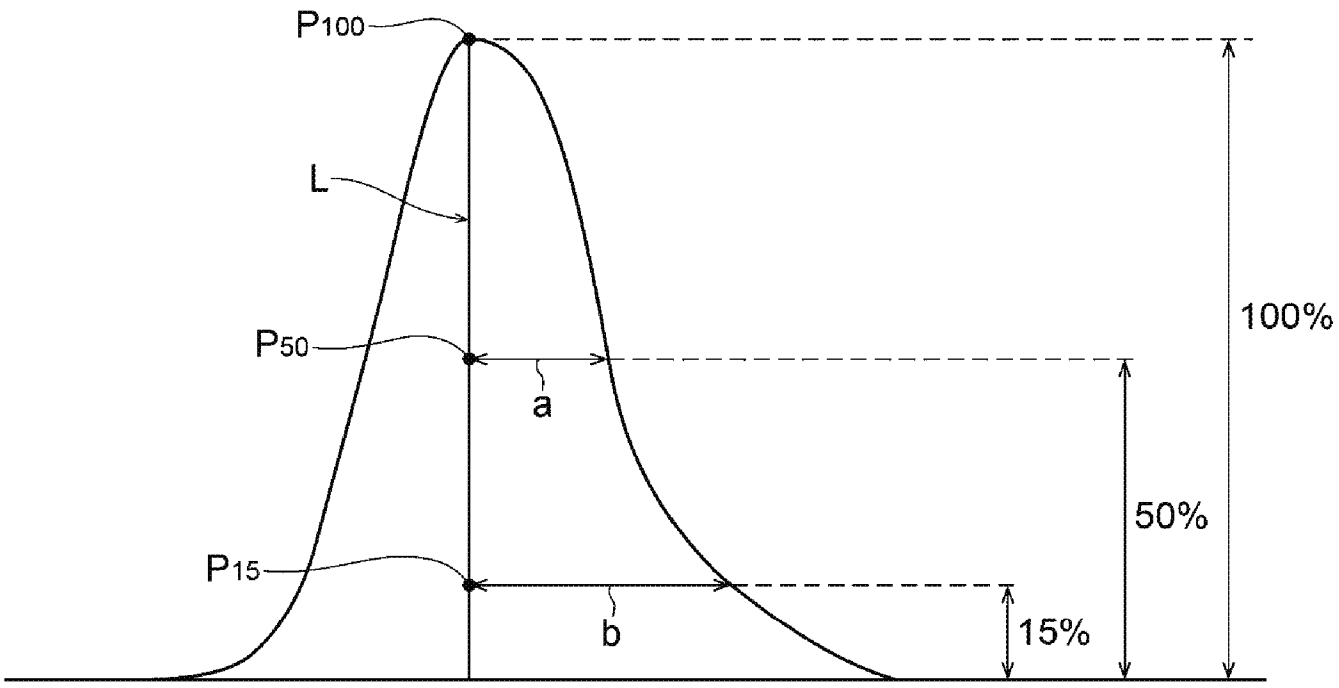
FIG. 1 is a graph showing an example of a molecular weight distribution curve of a toner according to Embodiment X satisfying Expression (1)

Hereinafter, exemplary embodiments of the invention will be described. The descriptions and examples of the exemplary embodiments are merely exemplifying the invention and therefore, a scope of the invention is not limited thereto.

First, an electrostatic charge image developing toner according to the first aspect (hereinafter also referred to as Embodiment X) will be described in detail.

Electrostatic Charge Image Developing Toner

An electrostatic charge image developing toner (hereinafter, also simply referred to as a "toner") according to the exemplary embodiment includes a styrene-acrylic resin, wherein the electrostatic charge image developing toner exhibits a z average molecular weight Mz of 80,000 to 400,000 and a molecular weight distribution curve satisfying Expression (1).

$$1.3 \leq b/a \leq 2.0 \qquad \text{Expression (1)}$$

(In Expression (1), a represents a width on a high molecular weight side from a perpendicular line at a height which is 50% of a height of a maximum peak, in a case where the perpendicular line is drawn down from the maximum peak of the molecular weight distribution curve, and b represents a width on a high molecular weight side shown with a perpendicular line at a height which is 15% of a height of the maximum peak, in a case where the perpendicular line is drawn down from the maximum peak of the molecular weight distribution curve.)

In an image forming apparatus, a toner image formed on an image holding member is transferred to a surface of a recording medium and the toner image is fixed to the recording medium by a fixing member which contacts the toner image to cause heating, pressurizing, or the like, thereby forming an image. As a toner used in such image forming, a toner containing a styrene-acrylic resin as a binder resin is used.

As the density of an image to be formed increases, the amount of toner (toner applied amount, TMA) increases. For example, in a case of forming a combination color image such as a color image, toners having plural colors are layered, and accordingly, the toner applied amount (TMA) increases.

However, in a case where images having a high image density and a large toner applied amount (TMA) (for example, images having toner applied amount of 14.4 g/m$^2$) are repeatedly formed (for example, 3,000 sheets of images are continuously printed), a toner image gradually becomes hard to be separated from a fixing member due to the viscosity of the toner. In a final stage of the repeated image forming, a part of the toner image is peeled and shifted to the fixing member side. That is, after performing the repeated image forming, the peeling of the toner image due to the fixing member occurs, and as a result, a difference in glossiness of images before and after the repeated image forming is caused. In addition, the peeling of a part of the toner image means that a layer of the toner image on a surface side (side coming into contact with the fixing member) is peeled and an intermediate layer is exposed to the surface, and accordingly, a portion where the peeling has occurred is recognized as color unevenness. In addition to the color unevenness, a part of an upper layer of the toner is peeled to cause ruggedness on a surface of an image, and this is recognized as gloss unevenness.

With respect to this, in the toner according to the exemplary embodiment, the z average molecular weight Mz is 80,000 to 400,000 and the molecular weight distribution curve satisfies Expression (1) ($1.3 \leq b/a \leq 2.0$). With the configuration, a difference in glossiness on images before and after repeatedly forming high-density images is prevented.

A reason thereof is assumed as follows.

First, an average molecular weight will be described. Examples of average molecular weights generally used include a number average molecular weight Mn, a weight average molecular weight Mw, and z average molecular weight Mz. Mn is an average molecular weight obtained by strongly reflecting the presence of a low molecular weight. Mw is an average molecular weight obtained by strongly reflecting the presence of a high molecular weight, and Mz is an average molecular weight obtained by more strongly reflecting the presence of a high molecular weight, than Mw. Accordingly, the toner according to the exemplary embodiment in which the z average molecular weight Mz which strongly reflects the presence of the resin component included in the toner is in the range described above, means that, particularly, a molecular weight of the component (resin component) corresponding to the high molecular weight side in the molecular weight distribution is 80,000 or more.

Next, Expression (1) will be described with reference to FIG. 1. FIG. 1 is a graph showing a molecular weight distribution curve of the toner according to the exemplary embodiment satisfying Expression (1). In the molecular weight distribution curve shown in FIG. 1, a maximum peak is set as $P_{100}$, and a perpendicular line L is drawn from the maximum peak $P_{100}$. In the perpendicular line L, a height which is 50% of the maximum peak height $P_{100}$ is set as $P_{50}$, and a height which is 15% of the maximum peak height $P_{100}$ is set as $P_{15}$. "a" in Expression (1) represents a length (width) from the perpendicular line L at the 50% height $P_{50}$ to the molecular weight distribution curve on the high molecular weight side (right side of FIG. 1) and "b" represents a length (width) from the perpendicular line L at the 15% height $P_{15}$ to the molecular weight distribution curve on the high molecular weight side (right side of FIG. 1). Accordingly, as shown in Expression (1), "b/a" which is 1.3 or more means that the width of the 15% height $P_{15}$ is 1.3 times or more of the width of 50% height $P_{50}$ of the molecular weight distribution curve on the high molecular weight side and a bottom portion of the molecular weight distribution curve on the high molecular weight side is spread for that width. The spread of the bottom portion of the molecular weight distribution curve on the high molecular weight side means that the toner is a toner including a component (resin component) having a particularly high molecular weight among the molecular weight distribution.

As described above, the toner according to the exemplary embodiment in which the z average molecular weight Mz obtained by extremely strongly reflecting the presence of the high molecular weight is 80,000 or more and "b/a" shown in Expression (1) is 1.3 or more, means a toner including a component (resin component) having a particularly high molecular weight exceeding 80,000.

The toner according to the exemplary embodiment includes the component (resin component) having a high molecular weight, and accordingly, the elasticity of the entire toner increases and viscosity thereof decreases. Accordingly, at the time when a toner image is fixed on a recording medium, the toner image is easily separated from the fixing member. Therefore, even in a case where images having a high image density and a large toner applied amount (TMA) (for example, images having a toner applied amount of 14.4 g/m$^2$) are repeatedly formed (for example, 3,000 sheets of images are continuously printed), the peeling of the toner image by the fixing member (shift of the toner image to the fixing member) is prevented due to the high elasticity and the low viscosity of the toner The occurrence of a difference in glossiness of the image, before and after repeatedly forming images, is prevented and the occurrence of color unevenness and gloss unevenness is also prevented.

In a case of using a recording medium having ruggedness such as embossed paper as the recording medium, particularly, a difference in glossiness before and after repeatedly forming images, color unevenness, and gloss unevenness significantly occur.

However, the toner according to the exemplary embodiment is a toner having a high elasticity and a low viscosity. Accordingly, even with respect to the recording medium having ruggedness such as embossed paper, the toner suitably permeates the ruggedness, and therefore, adhesiveness with a recording medium is obtained. As a result, the peeling of the toner image due to the fixing member (shift of the toner image to the fixing member) is prevented. Even in a case where images having a high image density and a large toner applied amount (TMA) (for example, images having a toner applied amount of 14.4 g/m$^2$) are repeatedly formed (for example, 3,000 sheets of images are continuously printed), the occurrence of a difference in glossiness before and after repeatedly forming images, color unevenness, and gloss unevenness is prevented.

As described above, according to the toner according to Embodiment X, the occurrence of a difference in glossiness of an image before and after repeatedly forming high-density images is prevented.

Expression (1)

In the toner according to the exemplary embodiment, the molecular weight distribution curve satisfies Expression (1), that is, [b/a] is from 1.3 to 2.0. In addition, [b/a] is preferably from 1.4 to 1.8 and more preferably from 1.5 to 1.7.

By setting [b/a] to be 1.3 or more in the molecular weight distribution curve of the toner, elasticity of the entire toner increases and viscosity thereof decreases. As a result, the occurrence of a difference in glossiness before and after repeatedly forming high-density images, and the occurrence of color unevenness and gloss unevenness are prevented. In addition, even in a case of using a recording medium having ruggedness such as embossed paper, the toner suitably permeates the ruggedness of the recording medium due to the high elasticity and low viscosity of the entire toner, and therefore, adhesiveness with the recording medium is obtained. Accordingly, the occurrence of a difference in glossiness before and after repeatedly forming high-density images, and the occurrence of color unevenness and gloss unevenness are prevented.

Meanwhile, by setting [b/a] to be 2.0 or less, the viscosity of the entire toner does not excessively decrease, thereby preventing the peeling on a part of a toner image due to insufficient viscosity. Accordingly, the occurrence of a difference in glossiness before and after repeatedly forming high-density images, and the occurrence of color unevenness and gloss unevenness are prevented. In addition, even in a case of using a recording medium having ruggedness such as embossed paper or even in a state where the toner is hardly melted due to a decrease of a fixing temperature of a fixing member after repeatedly forming high-density images, the toner suitably permeates the ruggedness of the recording medium, and therefore, adhesiveness with the recording medium is obtained. Therefore, the occurrence of a difference in glossiness before and after repeatedly forming high-density images, and the occurrence of color unevenness and gloss unevenness are prevented.

Expression (2)/(Ratio of Widths of High Molecular Weight Side and Low Molecular Weight Side of Molecular Weight Distribution Curve)

With respect to the toner according to the exemplary embodiment, the molecular weight distribution curve preferably satisfies Expression (2).

$$1.0<(b/a)/(b'/a')\leq 1.8 \qquad \text{Expression (2)}$$

(In Expression (2), a represents a width on a high molecular weight side from a perpendicular line at a height which is 50% of a height of a maximum peak, in a case where the perpendicular line is drawn down from the maximum peak of the molecular weight distribution curve, and a' represents a width on a low molecular weight side from a perpendicular line at a height which is 50% of a height of a maximum peak, in a case where the perpendicular line is drawn down from the maximum peak of the molecular weight distribution curve. b represents a width on a high molecular weight side from a perpendicular line at a height which is 15% of a height of the maximum peak, in a case where the perpendicular line is drawn down from the maximum peak of the molecular weight distribution curve, and b' represents a width on a low molecular weight side from a perpendicular line at a height which is 15% of a height of the maximum peak, in a case where the perpendicular line is drawn down from the maximum peak of the molecular weight distribution curve.)

"a'" in Expression (2) represents a length (width) from the perpendicular line L at the 50% height $P_{50}$ to the molecular weight distribution curve on the low molecular weight side (left side) in the molecular weight distribution curve, and "b'" represents a length (width) from the perpendicular line L at the 15% height $P_{15}$ to the molecular weight distribution curve on the low molecular weight side (left side). Accordingly, as shown in Expression (2), "(b/a)/(b'/a')" which exceeds 1.0 means that a bottom portion of the molecular weight distribution curve on the high molecular weight side is spread wider than a bottom portion on the low molecular weight side. That is, the toner according to the exemplary embodiment indicates a toner which is not a toner having an entirely broad molecular weight distribution, and is a toner having a molecular weight distribution curve in which only the bottom portion on the high molecular weight side is spread. In addition, this means that a component (resin component) having a particularly high molecular weight in the molecular weight distribution is included and a content of a component (resin component) having a particularly low molecular weight is small.

Accordingly, by setting "(b/a)(b'/a')" to exceed 1.0 in the molecular weight distribution curve, an increase in viscosity in accordance with an increase in amount of a low-molecular-weight component is prevented. As a result, the occurrence of a difference in glossiness before and after repeatedly forming high-density images, and the occurrence of color unevenness and gloss unevenness are easily prevented.

Meanwhile, by setting "(b/a)/(b'/a')" to be 1.8 or more in the molecular weight distribution curve, the amount of a high-molecular-weight component does not excessively increase and viscosity of the entire toner does not excessively decrease. Therefore, the peeling occurring on a part of the toner image due to insufficient viscosity is prevented, and the occurrence of a difference in glossiness before and after repeatedly forming high-density images, and the occurrence of color unevenness and gloss unevenness are easily prevented.

The "(b/a)(b'/a')" is preferably more than 1.0 and 1.8 or less, more preferably 1.1 to 1.6, and even more preferably 1.2 to 1.5.

z Average Molecular Weight Mz

With respect to the toner according to the exemplary embodiment, the z average molecular weight Mz is 80,000 to 400,000. The z average molecular weight Mz is preferably 100,000 to 400,000 and more preferably 150,000 to 300,000.

By setting the z average molecular weight Mz of the toner to be 80,000 or more, elasticity of the entire toner increases and viscosity thereof decreases. As a result, the occurrence of a difference in glossiness before and after repeatedly forming high-density images, and the occurrence of color unevenness and gloss unevenness are prevented. In addition, even in a case of using a recording medium having ruggedness such as embossed paper, the toner suitably permeates the ruggedness of the recording medium and adhesiveness with the recording medium is obtained, due to the high elasticity and low viscosity of the entire toner. Therefore, the occurrence of a difference in glossiness before and after repeatedly forming high-density images, and the occurrence of color unevenness and gloss unevenness are prevented.

Meanwhile, by setting the z average molecular weight Mz of the toner to be 400,000 or less, the viscosity of the entire toner does not excessively decrease, thereby preventing the peeling occurring on a part of a toner image due to insufficient viscosity. Accordingly, the occurrence of a difference in glossiness before and after repeatedly forming high-density images, and the occurrence of color unevenness and gloss unevenness are prevented. In addition, even in a case of using a recording medium having ruggedness such as embossed paper, or even in a state where the toner is hardly melted due to a decrease of a fixing temperature of a fixing member after repeatedly forming high-density images, the toner suitably permeates the ruggedness of the recording medium and adhesiveness with the recording medium is obtained. Therefore, the occurrence of a difference in glossiness before and after repeatedly forming high-density images, and the occurrence of color unevenness and gloss unevenness are prevented.

Number Average Molecular Weight Mn

With respect to the toner according to the exemplary embodiment, the number average molecular weight Mn is preferably 7,000 to 25,000, more preferably 10,000 to 20,000, and even more preferably 12,000 to 16,000.

The number average molecular weight Mn is an average molecular weight obtained by strongly reflecting the presence of a low molecular weight. The Mn of 7,000 or more means that an increase in amount of a component (resin component) having an extremely low molecular weight, which is a molecular weight significantly less than 7,000, particularly on the low molecular weight side of the molecular weight distribution curve, is prevented. Accordingly, by setting the Mn to be 7,000 or more, an increase in viscosity in accordance with an increase in amount of a low-molecular-weight component is prevented, and the occurrence of a difference in glossiness before and after repeatedly forming high-density images, and the occurrence of color unevenness and gloss unevenness are easily prevented.

Meanwhile, by setting the number average molecular weight Mn to be 25,000 or less, viscosity of the entire toner does not excessively decrease. Therefore, the peeling occurring on a part of the toner image due to insufficient viscosity is prevented, and the occurrence of a difference in glossiness before and after repeatedly forming high-density images, and the occurrence of color unevenness and gloss unevenness are easily prevented. In addition, even in a case of using a recording medium having ruggedness such as embossed paper, the toner suitably permeates the ruggedness of the recording medium and adhesiveness with the recording medium is obtained, even in a state where the toner is hardly melted due to a decrease of a fixing temperature of a fixing member after repeatedly forming high-density images. Therefore, the occurrence of a difference in glossiness before and after repeatedly forming high-density images, and the occurrence of color unevenness and gloss unevenness are prevented.

Ratio (Mz/Mn)

In the toner according to the exemplary embodiment, the ratio (Mz/Mn) of the z average molecular weight Mz to the number average molecular weight Mn is preferably 8 to 25, more preferably 10 to 20, and even more preferably 12 to 20.

The ratio (Mz/Mn) of 8 or more means that the molecular weight distribution curve is sufficiently broad, and means that a component (resin component) having a particularly high molecular weight is included, thereby providing the entire toner having a high elasticity and a low viscosity. Accordingly, the occurrence of a difference in glossiness before and after repeatedly forming high-density images, and the occurrence of color unevenness and gloss unevenness are easily prevented.

Meanwhile, by setting the ratio (Mz/Mn) to be 25 or less, the molecular weight distribution curve is not excessively broad, and viscosity of the entire toner does not excessively decrease, thereby preventing the peeling occurring on a part of a toner image due to insufficient viscosity. Accordingly, the occurrence of a difference in glossiness before and after repeatedly forming high-density images, and the occurrence of color unevenness and gloss unevenness are prevented. In addition, even in a case of using a recording medium having ruggedness such as embossed paper, the toner suitably permeates the ruggedness of the recording medium and adhesiveness with the recording medium is obtained, even in a state where the toner is hardly melted due to a decrease of a fixing temperature of a fixing member after repeatedly forming high-density images. Therefore, the occurrence of a difference in glossiness before and after repeatedly forming high-density images, and the occurrence of color unevenness and gloss unevenness are prevented.

Method of creating molecular weight distribution curve and method of calculating each average molecular weight Each average molecular weight is measured by gel permeation chromatography (GPC). The molecular weight measurement by GPC is performed by GPC.HLC-8120 GPC manufactured by Tosoh Corporation as a measuring device, TSKgel Super HM-M (15 cm) manufactured by Tosoh Corporation, as a column, and a THF solvent.

The molecular weight distribution curve (molecular weight calibration curve) is created with a monodisperse polystyrene standard sample from the measurement results. The z average molecular weight Mz and the number average molecular weight Mn are calculated from the obtained molecular weight distribution curve.

Insoluble Component to Tetrahydrofuran (Component insoluble in tetrahydrofuran)

In the toner according to the exemplary embodiment, a content of an insoluble component to tetrahydrofuran (components insoluble in THF excluding a pigment, a release agent, and an external additive in a case of including one or more kinds of additives selected from a pigment, a release agent, and an external additive) is preferably 0.5% by weight to 6% by weight, more preferably 2% by weight to 6% by weight, and even more preferably 3% by weight to 6% by weight, with respect to a total amount of the toner.

It is thought that the tetrahydrofuran (THF) insoluble component excluding a pigment, a release agent, and an external additive in the toner mainly represents a solid content derived from a resin component, that is, represents a gelationous resin component having a crosslinked structure. A content of a gel content in the resin component is an index for a content of a component (resin component) having a particularly high molecular weight.

Accordingly, in a case where the content of the THF insoluble component is 0.5% by weight or more, an increase in elasticity and a decrease in viscosity of the entire toner easily occur. As a result, the occurrence of a difference in glossiness of images before and after repeatedly forming the images is easily prevented, and the occurrence of color unevenness and gloss unevenness is also easily prevented.

Meanwhile, in a case where the content of the THF insoluble component is 6% by weight or less, the viscosity of the entire toner does not excessively decrease, thereby easily preventing the occurrence of a difference in glossiness of images before and after repeatedly forming high-density images, and the occurrence of color unevenness and gloss unevenness.

Here, a measurement method of the content of the tetrahydrofuran (THF) insoluble component excluding a pigment, a release agent, and an external additive will be described.

In a case where a toner which is a measurement target includes an external additive, first, the external additive is removed to obtain toner particles (base particles), by a well-known method such as a method of applying ultrasonic vibration into liquid.

Then, the toner particles are put into an Erlenmeyer flask, THF is put thereto, and the Erlenmeyer flask is sealed and allowed to stand for 24 hours. After that, the content is moved to a glass tube for centrifugal separation, a material obtained by washing by adding THF again into the Erlenmeyer flask is moved to the glass tube for centrifugal separation and sealed, and the centrifugal separation is performed under the conditions of a rotation rate of 20,000 rpm at −10° C. for 30 minutes. After the centrifugal separation, the content is extracted and allowed to stand, a supernatant is removed, and the THF insoluble component of the entire toner particles is separated.

By heating the obtained THF insoluble component to 600° C. at a rate of temperature increase of 20° C./min in a nitrogen gas stream, the release agent is volatilized in the initial stage, and then the solid content derived from the resin component (that is, gelationous resin component) is subjected to thermal decomposition. The residual components are mainly a component derived from the pigment and a small amount of other additives (solid content derived from the inorganic component and the like). From the ratio, a content of the THF insoluble component in the toner excluding the pigment, the release agent, and the external additive is calculated.

Difference (T2−T1) Between Endothermic Peak Temperature at Time of Heating of Release Agent and Exothermic Peak Temperature at Time of Cooling After Heating In a case where the toner according to the exemplary embodiment includes a release agent, a difference (T2−T1) between an endothermic peak temperature T1 of the release agent at the time of heating (first heating) of differential scanning calorimetry (DSC) and an exothermic peak temperature T2 of the release agent at the time of cooling (cooling after the first heating) is preferably 0° C. to 10° C., more preferably 3° C. to 10° C., and even more preferably 5° C. to 10° C.

The endothermic peak of the release agent included in the toner obtained by the DSC is affected by the content of the gel content in the resin component (gelationous resin component) in the toner. Specifically, as the amount of the gel content is large, recrystallization of the release agent is disturbed, thereby further increasing the difference (T2−T1) between the endothermic peak temperature T1 regarding the release agent at the time of the first heating and the exothermic peak temperature T2 at the time of cooling after the first heating.

Accordingly, the difference (T2−T1) which is 10° C. or lower means that the disturbance of the recrystallization of the release agent at the time of the DSC measurement is prevented, that is, an increase in amount of the gel content (gelationous resin component) of the resin component in the toner is prevented and the amount thereof does not become an excessive amount. By preventing an increase in content of the gel content of the resin component in the toner, the disturbance of permeation of the release agent in a case of fixing a toner image is also prevented. As a result, releasing properties with respect to a fixing member at the time of fixing are exhibited in an excellent manner, the peeling of the toner image (shift of the toner image to the fixing member) is prevented, and the occurrence of a difference in glossiness of images before and after repeatedly forming images, and the occurrence of color unevenness and gloss unevenness are easily prevented.

Thermal properties of the toner according to the exemplary embodiment such as the endothermic peak temperature T1 of the release agent at the time of the first heating and the exothermic peak temperature T2 of the release agent at the time of cooling after the first heating are obtained by differential scanning calorimetry (DSC).

The thermal properties of the toner are measured based on ASTM D3418-99 by DSC. In the measurement, a differential scanning calorimeter (manufactured by Shimadzu Corporation, product name: DSC-60A) is used, melting temperatures of indium and zinc are used for temperature correction of a device detection unit, and heat of fusion of indium is used for correction of a calorie. An aluminum pan is used for a measurement sample, an empty pan is set for comparison, and measurement is performed.

Specifically, 8 mg of the toner is set to a sample holder of DSC-60A, the first heating (heating step) is performed from 0° C. to 150° C. at a rate of temperature increase of 10° ° C./min, and the toner is held at 150° C. for 5 minutes. Next, the cooling (cooling step) is performed to 0° C. at a rate of temperature decrease of −10° C./min, and the toner is held at 0° C. for 5 minutes.

The endothermic peak temperature T1 of the release agent in the first heating is obtained from a peak appearing on a DSC chart obtained at the time of the heating step, and the exothermic peak temperature T2 of the release agent in the cooling after the first heating is obtained from a peak appearing on a DSC chart obtained at the time of the cooling after the heating.

The endothermic peak caused by the resin and the endothermic peak caused by the release agent appear on the DSC chart, and accordingly, it is necessary to distinguish whether the peak is caused by the resin or caused by the release agent. A method of identify whether the peak appearing on the DSC chart is caused by the resin or caused by the release agent is as follows, for example.

The resin and the release agent are separated by utilizing a difference in solubility of both components with respect to a solvent, and the separated components are identified by NMR, mass spectrography, GPC, and the like. Examples of the solvent include tetrahydrofuran, diethyl ether, acetone, and methyl ethyl ketone. In a case of using tetrahydrofuran, the resin is easily dissolved in tetrahydrofuran and the release agent tends to be hardly dissolved in tetrahydrofuran. A method of obtaining the DSC chart for each identified component, and comparing the endothermic peak appearing on the obtained chart and that on the DSC chart of the toner to each other, thereby distinguishing whether the peak appearing on the DSC chart of the toner is an endothermic peak caused by the resin or an endothermic peak caused by the release agent, is used.

BET Specific Surface Area

In the toner according to the exemplary embodiment, the BET specific surface area is preferably 1.5 $m^2/g$ to 2.5 $m^2/g$, more preferably 1.7 $m^2/g$ to 2.4 $m^2/g$, and even more preferably 1.8 $m^2/g$ to 2.1 $m^2/g$.

The BET specific surface area of the toner which is 2.5 $m^2/g$ or less means that a surface of the base particle of the toner (toner particle) is not rough and has a shape close to a spherical shape. By setting the BET specific surface area to be 2.5 $m^2/g$ or less, charging properties necessary for development are obtained, transfer efficiency of the toner increases, accordingly, the toner is easily evenly loaded on a surface of an image, and it is possible to prevent the occurrence of a difference in glossiness due to images before and after repeatedly forming high-density images.

Meanwhile, by setting the BET specific surface area of the toner to be 1.5 $m^2/g$ or more, charging properties necessary for development are obtained, transfer efficiency of the toner increases, accordingly, the toner is easily evenly loaded on a surface of an image, and it is possible to prevent the occurrence of a difference in glossiness due to images before and after repeatedly forming high-density images.

Here, the measurement of the BET specific surface area of the toner is performed by a nitrogen substitution method. Specifically, the measurement is performed by a three-point method by a SA 3100 specific surface area measurement device (manufactured by Beckman Coulter, Inc.).

Producing Method of Resin (Method of Achieving Toner Satisfying Expression (1) and z Average Molecular Weight Mz)

In the exemplary embodiment, a polymer obtained by polymerizing at least an acrylate monomer including two or more vinyl groups (that is, di- or higher functional acrylate) as a styrene-acrylic resin is preferably included.

In a case of producing the toner by an aggregation and coalescence method, it is preferable to prepare a resin particle dispersion used in the aggregation and coalescence method as follows. That is, as a mixed solution obtained by mixing each raw material of the styrene-acrylic resin, a mixed solution of two or more kinds including a mixed solution ($LQ_L$) of the di- or higher functional acrylate having a low concentration and a mixed solution ($LQ_H$) thereof having a high concentration is prepared, a resin particle which is a core is formed by firstly polymerizing the resin by using the mixed solution ($LQ_L$), the mixed solution ($LQ_H$) is further added into the mixed solution, where the core is formed, and polymerized to form the resin particle, and accordingly, it is preferable that a resin particle having different degrees of formation of crosslinked structures in the inner portion and the surface is formed. By preparing the resin particle dispersion by the method, a percentage of the resin having a crosslinked structure on the surface side is higher than the inner portion, that is, a dispersion including the resin particle having a high percentage of the resin having a high molecular weight on the surface side is obtained.

By producing the toner by the resin particle dispersion by an aggregation and coalescence method, a toner satisfying Expression (1) and satisfying the z average molecular weight Mz to be in the range described above is obtained. In addition, a toner satisfying Expression (2), various physical properties such as the number average molecular weight Mn, the ratio (Mz/Mn), the content of the THF insoluble component, the difference (T2−T1), and the BET specific surface area is easily obtained.

Next, the electrostatic charge image developing toner according to the second aspect (hereinafter also referred to as Embodiment A) will be described in detail.

Electrostatic Charge Image Developing Toner

An electrostatic charge image developing toner (hereinafter, also simply referred to as a "toner") according to the exemplary embodiment includes a styrene-acrylic resin, wherein the electrostatic charge image developing toner exhibits a z average molecular weight Mz is 100,000 to 400,000 and a molecular weight distribution curve satisfying Expression (A).

$$0.75 \leq (c+d)/(2\times d) \leq 0.95 \qquad \text{Expression (A)}$$

(In Expression (A), c represents a width on a low molecular weight side from a perpendicular line at a height which is 50% of a height of a maximum peak, in a case where the perpendicular line is drawn down from the maximum peak of the molecular weight distribution curve, and d represents a width on a high molecular weight side from a perpendicular line at a height which is 50% of a height of the maximum peak, in a case where the perpendicular line is drawn down from the maximum peak of the molecular weight distribution curve.)

In an image forming apparatus, a toner image formed on an image holding member is transferred onto a surface of a recording medium and the toner image is fixed on the recording medium by a fixing member which contacts the toner image to cause heating, pressurizing, or the like, thereby forming an image. As a toner used in such image forming, a toner using a styrene-acrylic resin as a binder resin is used.

In order to improve release properties of the toner image and the fixing member on a recording medium, for example, a method of increasing elasticity of the toner is used. As the method of increasing elasticity of the toner, a method of increasing the amount of the high-molecular-weight component by broadening the molecular weight distribution of the toner is considered. However, by broadening the molecular weight distribution, a percentage of the low-molecular-weight component also increases, and viscosity of the toner caused by the low-molecular-weight component increases. In the toner having the increased viscosity, in a case where images are continuously printed on paper having heat capacity such as thin paper or thick paper, the occurrence of a difference in glossiness has occurred between the first printed matter and the printed matter after the continuous printing.

Accordingly, in a case of forming images on each thin paper (for example, paper having a basis weight of 52 g/m$^2$) before and after repeatedly forming images on thick paper (for example, paper having a basis weight of 209 g/m$^2$) (for example, continuously forming 100 sheets of images), it is necessary to prevent a difference in glossiness occurring between the image on the thin paper before repeatedly forming images on the thick paper and the image on the thin paper after repeatedly forming images.

The reason of the difference in glossiness occurring on the image formed on the thin paper before and after the repeatedly forming images on the thick paper is assumed as follows.

The thin paper is hardly peeled off from the fixing member due to low heat capacity and low hardness of the paper, and accordingly, as a temperature of the fixing member increases, releasing properties from the fixing member is deteriorated. Meanwhile, since the thick paper has high heat capacity, a temperature of the fixing member easily decreases, in a case where the images are continuously printed by using the thick paper. In this circumstance, a research is carried out regarding a case where one sheet of an image is printed on thin paper, an image is continuously printed on thick paper, and then, an image is printed on the thin paper again. In the image on the thin paper before continuously printing on the thick paper, the releasing properties from the fixing member is deteriorated, thereby easily decreasing glossiness (the tendency is stronger particularly in a half-tone portion of the image). Meanwhile, in the image on the thin paper after continuously printing on the thick paper, the temperature of the fixing member easily decreases, thereby improving the releasing properties and increasing glossiness (the tendency is stronger particularly in a half-tone portion of the image). As a result, it is thought that a difference in glossiness occurs on the image formed on each thin paper, particularly a half-tone portion of the image, before and after continuously printing images on the thick paper.

With respect to this, in the toner according to the exemplary embodiment, the z average molecular weight Mz is 100,000 to 400,000 and the molecular weight distribution curve satisfies Expression (A) ($0.75 \leq (c+d)/(2\times d) \leq 0.95$). With the configuration, a difference in glossiness occurring on the image formed on each thin paper before and after repeatedly forming images on the thick paper is prevented.

A reason thereof is assumed as follows.

First, an average molecular weight will be described. Examples of average molecular weights generally used include a number average molecular weight Mn, a weight average molecular weight Mw, and z average molecular weight Mz. Mn is an average molecular weight obtained by strongly reflecting the presence of a low-molecular-weight component, Mw is an average molecular weight obtained by strongly reflecting the presence of a high-molecular-weight component, and Mz is an average molecular weight obtained by more strongly reflecting the presence of a high-molecular-weight component, than Mw. Accordingly, the toner according to the exemplary embodiment in which the z average molecular weight Mz which strongly reflects the presence of the resin component included in the toner is in the range described above, means that, particularly, a molecular weight of the component (resin component) corresponding to the high molecular weight side in the molecular weight distribution is 100,000 or more.

Figure 2:
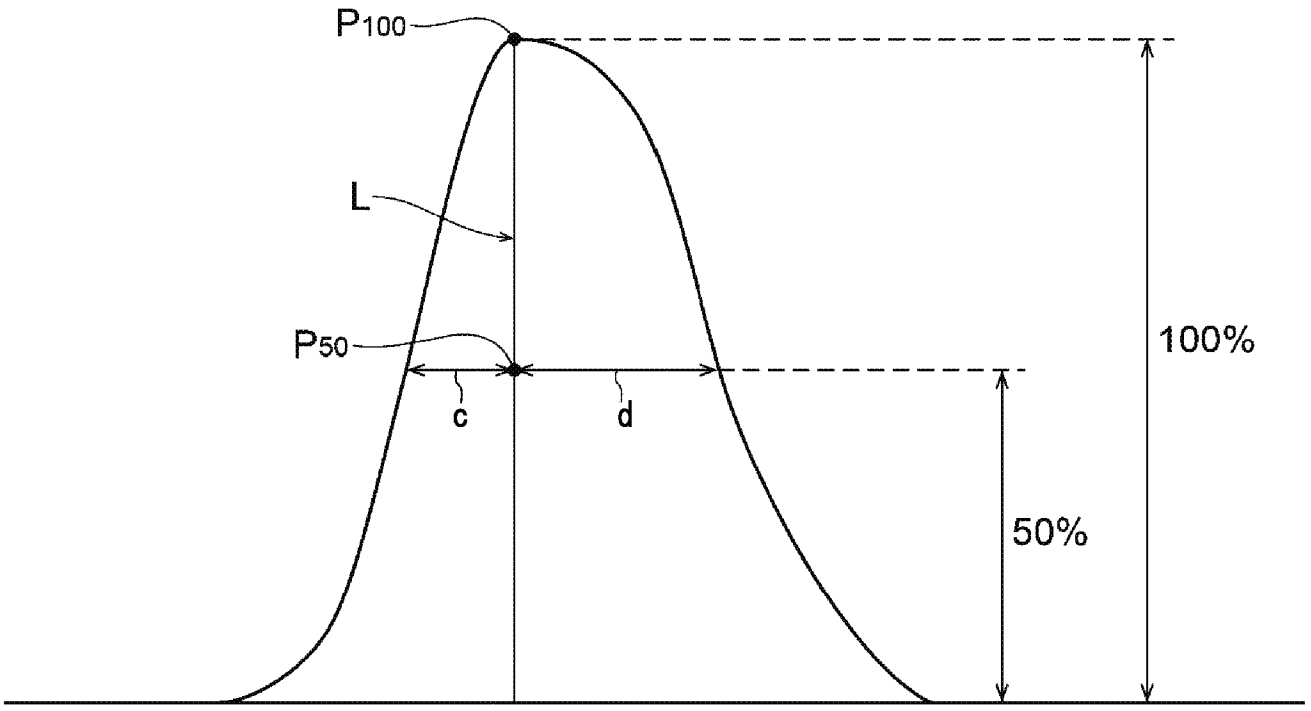
FIG. 2 is a graph showing an example of a molecular weight distribution curve of a toner according to Embodiment A satisfying Expression (A)

Next, Expression (A) will be described with reference to FIG. 2. FIG. 2 is a graph showing a molecular weight distribution curve of the toner according to the exemplary embodiment satisfying Expression (A). In the molecular weight distribution curve shown in FIG. 2, a maximum peak is set as $P_{100}$, and a perpendicular line L is drawn from the maximum peak $P_{100}$. In the perpendicular line L, a height which is 50% of the maximum peak height $P_{100}$ is set as $P_{50}$. "c" in Expression (A) represents a length (width) from the perpendicular line L at the 50% height $P_{50}$ to the molecular weight distribution curve on the low molecular weight side (left side of FIG. 2) and "d" represents a length (width) from the perpendicular line L at the 50% height $P_{50}$ to the molecular weight distribution curve on the high molecular weight side (right side of FIG. 2). Accordingly, as shown in Expression (A), "(c+d)/(2×d)" which is 0.95 or less means that the width of the 50% height $P_{50}$ of the molecular weight distribution curve on the high molecular weight side is longer than the width of the 50% height $P_{50}$ of the molecular weight distribution curve on the low molecular weight side. In a case where the maximum peak of the molecular weight distribution curve is set as $P_{100}$, the toner of the exemplary embodiment indicates a toner having a larger amount of a component (resin component) on the high molecular weight than a component (resin component) on the low molecular weight side.

A large amount of the toner according to the exemplary embodiment includes the component (resin component) having a high molecular weight, accordingly, elasticity of the entire toner increases. Meanwhile, the amount of the component (resin component) having a low molecular weight, and accordingly, an increase in viscosity is prevented. Accordingly, in a case where a toner image is fixed on a recording medium, the releasing properties of the toner image with respect to the fixing member are improved. In a state where the temperature of the fixing member is at high, even in the image formed on the thin paper before repeatedly forming images on the thick paper, the peeling from the fixing member is performed in an excellent manner, and accordingly, a decrease in glossiness is prevented.

As a result, even in a case of forming images on each thin paper (for example, paper having a basis weight of 52 g/m$^2$) before and after repeatedly forming images on thick paper (for example, paper having a basis weight of 209 g/m$^2$) (for example, continuously forming 100 sheets of images), a difference in glossiness occurring on the image formed on each thin paper before and after repeatedly forming images on the thick paper is prevented.

Expression (A)

In the toner according to the exemplary embodiment, the molecular weight distribution curve satisfies Expression (A), that is, [(c+d)/(2×d)] is 0.75 to 0.95. In addition, [(c+d)/(2×d)] is preferably 0.8 to 0.9 and more preferably 0.83 to 0.87.

By setting [(c+d)/(2×d)] to be 0.95 or less in the molecular weight distribution curve of the toner, elasticity of the entire toner increases and viscosity thereof decreases. As a result, a difference in glossiness occurring on the image formed on each thin paper before and after repeatedly forming images on the thick paper is prevented.

Meanwhile, by setting [(c+d)(2×d)] to be 0.75 or more, the viscosity of the entire toner does not excessively decrease, thereby preventing the peeling occurring on a part of a toner image due to insufficient viscosity, and a difference in glossiness occurring on the image formed on each thin paper before and after repeatedly forming images on the thick paper is prevented.

z Average Molecular Weight Mz

With respect to the toner according to the exemplary embodiment, the z average molecular weight Mz is 100,000 to 400,000. The z average molecular weight Mz is preferably 150,000 to 350,000 and more preferably 200,000 to 300,000.

By setting the z average molecular weight Mz of the toner to be 100,000 or more, elasticity of the entire toner increases and viscosity thereof decreases. As a result, a difference in glossiness occurring on the image formed on each thin paper before and after repeatedly forming images on the thick paper is prevented.

Meanwhile, by setting the z average molecular weight Mz of the toner to be 400,000 or less, the viscosity of the entire toner does not excessively decrease, thereby preventing the peeling occurring on a part of a toner image due to insufficient viscosity. Accordingly, a difference in glossiness occurring on the image formed on each thin paper before and after repeatedly forming images on the thick paper is prevented.

The creating method of the molecular weight distribution curve and the calculation method of the average molecular weight are the same as those in Embodiment X.

Difference (T4−T3) Between First Endothermic Peak Temperature of Release Agent and Second Endothermic Peak Temperature In a case where the toner according to the exemplary embodiment includes a release agent, a difference (T4−T3) between an endothermic peak temperature T3 of the release agent in the first heating of differential scanning calorimetry (DSC) and an endothermic peak temperature T4 of the release agent in the second heating is preferably 0° C. to 5° C., more preferably 0° C. to 3.5° C., and even more preferably 0° C. to 2.0° C.

The endothermic peak of the release agent included in the toner obtained by the DSC is affected by the content of the gel content in the resin component (gelationous resin component) in the toner. Specifically, as the amount of the gel content is large, recrystallization of the release agent is disturbed, thereby further increasing the difference (T4−T3) between the endothermic peak temperature T3 regarding the release agent in the first heating and the endothermic peak temperature T4 in the second heating.

Accordingly, the difference (T4−T3) which is 5° C. or lower means that the disturbance of the recrystallization of the release agent at the time of the DSC measurement is prevented, that is, an increase in amount of the gel content (gelationous resin component) of the resin component in the toner is prevented and the amount thereof does not become an excessive amount. By preventing an increase in content of the gel content of the resin component in the toner, the disturbance of permeation of the release agent in a case of fixing a toner image is also prevented. As a result, releasing properties with respect to a fixing member at the time of fixing are exhibited in an excellent manner, a difference in glossiness occurring on the image formed on each thin paper before and after repeatedly forming images on the thick paper is easily prevented.

Thermal properties of the toner according to the exemplary embodiment such as the endothermic peak temperature T3 of the release agent in the first heating and the endothermic peak temperature T4 of the release agent in the second heating are obtained by differential scanning calorimetry (DSC).

The thermal properties of the toner are measured based on ASTM D3418-99 by DSC. In the measurement, a differential scanning calorimeter (manufactured by Shimadzu Corporation, product name: DSC-60A) is used, melting temperatures of indium and zinc are used for temperature correction of a device detection unit, and heat of fusion of indium is used for correction of a calorie. An aluminum pan is used for a measurement sample, an empty pan is set for comparison, and measurement is performed.

Specifically, 8 mg of the toner is set to a sample holder of DSC-60A, the first heating (first heating step) is performed from 0° C. to 150° C. at a rate of temperature increase of 10° C./min, and the toner is held at 150° C. for 5 minutes. Next, the cooling is performed to 0° C. at a rate of temperature decrease of −10° C./min, and the toner is held at 0° C. for 5 minutes. The second heating (second heating step) is performed from 0° C. to 150° C. at a rate of temperature increase of 10° C./min.

The endothermic peak temperature T3 of the release agent in the first heating is obtained from a peak appearing on a DSC chart obtained at the time of the first heating step, and the endothermic peak temperature T4 of the release agent in the second heating is obtained from a peak appearing on a DSC chart obtained at the time of the second heating step.

The endothermic peak caused by the resin and the endothermic peak caused by the release agent appear on the DSC chart, and accordingly, it is necessary to distinguish whether the peak is caused by the resin or caused by the release agent. A method of identify whether the peak appearing on the DSC chart is caused by the resin or caused by the release agent is as follows, for example.

The resin and the release agent are separated by utilizing a difference in solubility of both components with respect to a solvent, and the separated components are identified by NMR, mass spectrography, GPC, and the like. Examples of the solvent include tetrahydrofuran, diethyl ether, acetone, and methyl ethyl ketone. In a case of using tetrahydrofuran, the resin is easily dissolved in tetrahydrofuran and the release agent tends to be hardly dissolved in tetrahydrofuran. A method of obtaining the DSC chart for each identified component, and comparing the endothermic peak appearing on the obtained chart and that on the DSC chart of the toner to each other, thereby distinguishing whether the peak appearing on the DSC chart of the toner is an endothermic peak caused by the resin or an endothermic peak caused by the release agent, is used.

BET Specific Surface Area

In the toner according to the exemplary embodiment, the BET specific surface area is preferably 1.3 $m^2/g$ to 2.5 $m^2/g$, more preferably 1.5 $m^2/g$ to 2.3 $m^2/g$, and even more preferably 1.7 $m^2/g$ to 2.1 $m^2/g$.

The BET specific surface area of the toner which is 2.5 $m^2/g$ or less means that a surface of the base particle of the toner (toner particle) is not rough and has a shape close to a spherical shape. By setting the BET specific surface area to be 2.5 $m^2/g$ or less, an effect for achieving a charging level necessary for development is obtained.

Meanwhile, by setting the BET specific surface area of the toner to be 1.3 $m^2/g$ or more, a degree of the ruggedness of the surface increases, and an external additive moves to a recess portion, thereby easily exposing the toner surface. An effect of hardly decreasing glossiness, in a case of the peeling from the fixing member, is obtained due to an increase in adhesiveness of the toners.

The measurement of the BET specific surface area of the toner is the same as that in Embodiment X.

Producing Method of Resin (Method of Achieving Toner Satisfying Expression (A) and z Average Molecular Weight Mz) In the exemplary embodiment, a polymer obtained by polymerizing at least an acrylate monomer including two or more vinyl groups (that is, di- or higher functional acrylate) as a styrene-acrylic resin is preferably included.

In a case of producing the toner by an aggregation and coalescence method, it is preferable to prepare a resin particle dispersion used in the aggregation and coalescence method as follows. That is, as a mixed solution obtained by mixing each raw material of the styrene-acrylic resin, a mixed solution of two or more kinds including a mixed solution ($LQ_L$) of the di- or higher functional acrylate having a low concentration and a mixed solution ($LQ_H$) thereof having a high concentration is prepared, a resin particle which is a core is formed by firstly polymerizing the resin by using the mixed solution ($LQ_L$), the mixed solution ($LQ_H$) is further added into the mixed solution, where the core is formed, and polymerized to form the resin particle, and accordingly, it is preferable that a resin particle having different degrees of formation of crosslinked structures in the inner portion and the surface is formed. By preparing the resin particle dispersion by the method, a percentage of the resin having a crosslinked structure on the surface side rather than the inner portion is high, that is, a dispersion including the resin particle having a high percentage of the resin having a high molecular weight on the surface side is obtained.

As the used amount of a chain transfer agent such as dodecanethiol decreases, the high molecular weight side may be broadened. In addition, as a monomer having a smaller molecular weight as an acrylate monomer having two or more vinyl groups (di- or higher functional acrylate) is used and the amount thereof (composition ratio) increases, the high molecular weight side may be broadened.

By producing the toner by the resin particle dispersion by an aggregation and coalescence method, a toner satisfying Expression (A) and satisfying the z average molecular weight Mz to be in the range described above is obtained. In addition, a toner satisfying the difference (T4−T3) and the BET specific surface area is easily obtained.

Hereinafter, the toner according to Embodiments X and A (collectively referred to as the exemplary embodiment) will be described in detail.

The toner according to the exemplary embodiment includes toner particles, and, if necessary, an external additive.

Toner Particles

The toner particles, for example, include a binder resin, if necessary, a colorant, a release agent, and other additives.

Binder Resin

The toner particles in the toner in the exemplary embodiment include a styrene-acrylic resin as the binder resin.

The styrene-acrylic resin is a copolymer obtained by copolymerizing at least a styrene monomer (monomer including a styrene skeleton) and an acryl monomer (monomer including an acryloyl skeleton or a methacryloyl skeleton).

In this specification, "(meth)acryl" is an expression including both of "acryl" and "methacryl".

Examples of the styrene monomer include styrene, alkyl-substituted styrene (for example, α-methylstyrene, 2-methylstyrene, 3-methylstyrene, 4-methylstyrene, 2-ethylstyrene, 3-ethylstyrene, or 4-ethylstyrene), halogen-substituted styrene (for example, 2-chlorostyrene, 3-chlorostyrene, or 4-chlorostyrene), and vinyl naphthalene.

Among these, styrene is preferable as the styrene monomer, from viewpoints of ease of a reaction, ease of control of a reaction, and availability.

The styrene monomer may be used singly or in combination of two or more kinds thereof.

Examples of the acryl monomer include (meth)acrylic acid and (meth)acrylic acid ester. Examples of (meth)acrylic acid ester include (meth)acrylic acid alkyl ester (for example, methyl (meth)acrylate, ethyl (meth)acrylate, n-propyl (meth)acrylate, n-butyl (meth)acrylate, n-pentyl (meth)acrylate, n-hexyl acrylate, n-heptyl (meth)acrylate, n-octyl (meth)acrylate, n-decyl (meth)acrylate, n-dodecyl (meth)acrylate, n-lauryl (meth)acrylate, n-tetradecyl (meth) acrylate, n-hexadecyl (meth)acrylate, n-octadecyl (meth) acrylate, isopropyl (meth)acrylate, isobutyl (meth)acrylate, t-butyl (meth)acrylate, isopentyl (meth)acrylate, amyl (meth)acrylate, neopentyl (meth)acrylate, isohexyl (meth) acrylate, isoheptyl (meth)acrylate, isooctyl (meth)acrylate, 2-ethylhexyl (meth)acrylate, cyclohexyl (meth)acrylate, and t-butylcyclohexyl (meth)acrylate), (meth)acrylic acid aryl ester (for example, phenyl (meth)acrylate, biphenyl (meth) acrylate, diphenylethyl (meth)acrylate, t-butylphenyl (meth) acrylate, and terphenyl (meth)acrylate), dimethylaminoethyl (meth)acrylate, diethylaminoethyl (meth)acrylate, methoxyethyl (meth)acrylate, 2-hydroxyethyl (meth)acrylate, β-carboxyethyl (meth)acrylate, and (meth)acrylamide.

From a viewpoint of fixing properties, (meth)acryl acid ester including an alkyl group having 2 to 14 carbon atoms (preferably 2 to 10 carbon atoms, more preferably 3 to 8 carbon atoms) is preferable as the acryl monomer.

The acryl monomer may be used singly or in combination of two or more kinds thereof.

A copolymerization ratio of the styrene monomer and the acryl monomer (based on weight, styrene monomer/acryl monomer) may be, for example, 85/15 to 70/30.

The styrene-acrylic resin may have a crosslinked structure. As the styrene-acrylic resin having a crosslinked structure, for example, a crosslinked material obtained by copolymerizing and crosslinking at least a styrene monomer, an acryl monomer, and a crosslinkable monomer.

As the crosslinkable monomer, a di- or higher functional crosslinking agent (preferably an acrylate monomer including two or more vinyl groups (polyfunctional acrylate)) is used, for example.

Examples of the di- or higher functional crosslinking agent include divinylbenzene, divinylnaphthalene, a di(meth)acrylate compound (for example, diethylene glycol di((meth)acrylate, methylene bis ((meth)acrylamide, decanediol diacrylate, and glycidyl ((meth)acrylate), polyester type di((meth)acrylate, and 2-([1'-methylpropylideneamino]carboxyamino) ethyl methacrylate.

Examples of tri or higher functional crosslinking agent include a tri(meth)acrylate compound (for example, pentaerythritol tri(meth)acrylate, trimethylol ethane tri(meth) acrylate, and trimethylolpropane tri(meth)acrylate), a tetra (meth)acrylate compound (for example, pentaerythritol tetra (meth)acrylate and oligoester (meth)acrylate), 2,2-bis (4-methacryloxy, polyethoxyphenyl) propane, diallyl phthalate, triallyl cyanurate, triallyl isocyanurate, triallyl trimellitate, and diaryl chloridate.

A copolymerization ratio of the crosslinkable monomer with respect to the entire monomer (based on weight, crosslinkable monomer/entire monomer) may be, for example, 2/1000 to 30/1000.

From a viewpoint of fixing properties, a glass transition temperature (Tg) of the styrene-acrylic resin may be, for example, 50° C. to 75° C., and is preferably 55° C. to 65° C. and more preferably 57° C. to 60° C.

The glass transition temperature is obtained by a DSC curve which is obtained by differential scanning calorimetry measurement (DSC), and more specifically, is obtained by "Extrapolating Glass Transition Starting Temperature" disclosed in a method for obtaining the glass transition temperature of "Testing Methods for Transition Temperatures of Plastics" in JIS K-7121-1987.

A content of the binder resin is, for example, preferably 40% by weight to 95% by weight, more preferably 50% by weight to 90% by weight, and even more preferably 60% by weight to 85% by weight with respect to a total amount of the toner particles.

Colorant

Examples of the colorant include various pigments such as carbon black, chrome yellow, Hansa yellow: benzidine yellow, threne yellow, quinoline yellow, pigment yellow, permanent orange GTR, pyrazolone orange, vulcan orange, watchung red, permanent red, brilliant carmine 3B, brilliant carmine 6B, DuPont oil red, pyrazolone red, lithol red, Rhodamine B Lake, Lake Red C, pigment red, rose bengal, aniline blue, ultramarine blue, calco oil blue, methylene blue chloride, phthalocyanine blue, pigment blue, phthalocyanine green, and malachite green oxalate: and various dyes such as acridine dyes, xanthene dyes, azo dyes, benzoquinone dyes, azine dyes, anthraquinone dyes, thioindigo dyes, dioxadine dyes, thiazine dyes, azomethine dyes, indigo dyes, phthalocyanine dyes, aniline black dyes, polymethine dyes, triphenylmethane dyes, diphenylmethane dyes, and thiazole dyes.

The colorants may be used singly or in combination of two or more types thereof.

As the colorant, the surface-treated colorant may be used, if necessary. The colorant may be used in combination with a dispersing agent. Plural colorants may be used in combination.

A content of the colorant is preferably 1% by weight to 30% by weight and more preferably 3% by weight to 15% by weight with respect to a total amount of the toner particles.

Release Agent

Examples of the release agent include hydrocarbon waxes; natural waxes such as camauba wax, rice wax, and candelilla wax; synthetic or mineral/petroleum waxes such as montan wax: and ester waxes such as fatty acid esters and montanic acid esters. The release agent is not limited thereto.

The melting temperature of the release agent is preferably 50° C. to 110° C. and more preferably 60° C. to 100° C.

The melting temperature is obtained from "melting peak temperature" described in the method of obtaining a melting temperature in JIS K 7121-1987 "Testing methods for transition temperatures of plastics", from a DSC curve obtained by differential scanning calorimetry measurement (DSC).

A content of the release agent is, for example, preferably 1% by weight to 20% by weight, and more preferably 5% by weight to 15% by weight with respect to the total amount of the toner particles.

Other Additives

Examples of other additives include well-known additives such as a magnetic material, a charge-controlling agent, and an inorganic particle. The toner particles include these additives as internal additives.

Characteristics of Toner Particles The toner particles may be toner particles having a single-layer structure, or toner particles having a so-called core/shell structure composed of a core (core particle) and a coating layer (shell layer) coated on the core.

Here, the toner particles having a core/shell structure may be configured with, for example, a core including a binder resin, and if necessary, other additives such as a colorant and a release agent, and a coating layer including a binder resin.

The volume average particle diameter (D50v) of the toner particles is preferably 2 μm to 10 μm, and more preferably 4 μm to 8 μm.

Various average particle diameters and various particle diameter distribution indices of the toner particles are measured by a COULTER MULTISIZER II (manufactured by Beckman Coulter, Inc.) and ISOTON-II (manufactured by Beckman Coulter, Inc.) as an electrolyte.

In the measurement, from 0.5 mg to 50 mg of a measurement sample is added to 2 ml of a 5% aqueous solution of surfactant (preferably sodium alkylbenzene sulfonate) as a dispersing agent. The obtained material is added to from 100 ml to 150 ml of the electrolyte.

The electrolyte in which the sample is suspended is subjected to a dispersion treatment using an ultrasonic disperser for 1 minute, and a particle diameter distribution of particles having a particle diameter of from 2 μm to 60 μm is measured by a COULTER MULTISIZER II using an aperture having an aperture diameter of 100 μm, 50,000 particles are sampled.

Cumulative distributions by volume and by number are drawn from the side of the smallest diameter with respect to particle diameter ranges (channels) separated based on the measured particle diameter distribution. The particle diameter in a case where the cumulative percentage becomes 16% is defined as that corresponding to a volume average particle diameter D16v and a number average particle diameter D16p, while the particle diameter in a case where the cumulative percentage becomes 50% is defined as that corresponding to a volume average particle diameter D50v and a number average particle diameter D50p. Furthermore, the particle diameter in a case where the cumulative percentage becomes 84% is defined as that corresponding to a volume average particle diameter D84v and a number average particle diameter D84p.

Using these, a volume average particle diameter distribution index (GSDv) is calculated as $(D84v/D16v)^{1/2}$, while a number average particle diameter distribution index (GSDp) is calculated as $(D84p/D16p)^{1/2}$.

An average circularity of the toner particles is preferably 0.94 to 1.00 and more preferably 0.95 to 0.98.

The average circularity of the toner particles is obtained by an expression of (perimeter of equivalent circle diameter)/(perimeter) [(perimeter of a circle having the same projected area as that of a particle image)/(perimeter of particle projection image)]. Specifically, the average circularity thereof is a value measured using the following method.

First, the toner particles which is a measurement target are sucked and collected, a flat flow is formed, stroboscopic light emission is instantly performed to obtain a particle image as a still image, and the average circularity is obtained using a flow-type particle image analysis device (FPIA-3000 manufactured by Sysmex Corporation) which performs image analysis of the particle image. 3,500 particles are sampled in a case of obtaining the average circularity.

In a case where the toner includes an external additive, the toner (developer) which is a measurement target is dispersed in water including a surfactant, and then, the ultrasonic treatment is performed to obtain toner particles from which the external additive is removed.

External Additives

As the other external additives, inorganic particles are used, for example. Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)n$, $Al_2O_3.2SiO_2$, $CaCO_3$, $MgCO_3$, $BaSO_4$, and $MgSO_4$.

The surfaces of the inorganic particles as the external additive may be treated with a hydrophobizing agent. The hydrophobizing treatment is performed by, for example, dipping the inorganic particles in a hydrophobizing agent. The hydrophobizing agent is not particularly limited and examples thereof include a silane coupling agent, silicone oil, a titanate coupling agent, and an aluminum coupling agent. These may be used singly or in combination of two or more kinds thereof.

Generally, the amount of the hydrophobizing agent is, for example, 1 part by weight to 10 parts by weight with respect to 100 parts by weight of the inorganic particles.

Examples of the external additives also include resin particles (resin particles such as polystyrene, polymethyl methacrylate (PMMA), and melamine resin) and a cleaning aid (for example, a metal salt of higher fatty acid represented by zinc stearate, and fluorine polymer particles).

The amount of the external additives externally added is, for example, preferably 0.01% by weight to 5% by weight, and more preferably 0.01% by weight to 2.0% by weight with respect to the amount of the toner particles.

Producing Method of Toner Next, a producing method of the toner according to the exemplary embodiment will be described.

The toner according to the exemplary embodiment is obtained by externally adding an external additive to toner particles, after producing the toner particles.

The toner particles may be produced using any of a dry preparing method (e.g., kneading and pulverizing method) and a wet preparing method (e.g., aggregation and coalescence method, suspension and polymerization method, and dissolution and suspension method). The toner particle preparing method is not particularly limited to these preparing methods, and a known preparing method is employed.

Among these, the toner particles are preferably obtained by an aggregation and coalescence method.

Specifically, in a case of producing the toner particles by the aggregation and coalescence method, for example, the toner particles are produced through the processes of: preparing a resin particle dispersion in which resin particles as a binder resin are dispersed (resin particle dispersion preparation process); aggregating the resin particles (if necessary, other particles) in the resin particle dispersion (if necessary, in the dispersion after mixing with other particle dispersions) to form aggregated particles (aggregated particle forming process); and heating the aggregated particle dispersion in which the aggregated particles are dispersed, to coalesce the aggregated particles, thereby forming toner particles (coalescence process).

Hereinafter, the processes will be described below in detail.

In the following description, a method of obtaining toner particles containing a colorant and a release agent will be described, but a colorant and a release agent is used, if necessary. Other additives may be used, in addition to a colorant and a release agent.

Resin Particle Dispersion Preparation Process

First, for example, a colorant particle dispersion in which colorant particles are dispersed and a release agent particle dispersion in which release agent particles are dispersed are prepared together with a resin particle dispersion in which resin particles as a binder resin are dispersed.

The resin particle dispersion is prepared by, for example, dispersing resin particles in a dispersion medium using a surfactant.

Examples of the dispersion medium used for the resin particle dispersion include aqueous mediums.

Examples of the aqueous mediums include water such as distilled water and ion exchange water, and alcohols. These may be used singly or in combination of two or more kinds thereof.

Examples of the surfactant include anionic surfactants such as a sulfuric ester salt, a sulfonate, a phosphate ester, and a soap; cationic surfactants such as an amine salt and a quaternary ammonium salt: and nonionic surfactants such as polyethylene glycol, an ethylene oxide adduct of alkyl phenol, and polyol. Among these, anionic surfactants and cationic surfactants are particularly preferably used. Nonionic surfactants may be used in combination with anionic surfactants or cationic surfactants.

The surfactants may be used singly or in combination of two or more kinds thereof.

Regarding the resin particle dispersion, as a method of dispersing the resin particles in the dispersion medium, a common dispersing method using, for example, a rotary shearing-type homogenizer, or a ball mill, a sand mill, or a DYNO mill having media is exemplified. Depending on the kind of the resin particles, resin particles may be dispersed in the resin particle dispersion according to, for example, a phase inversion emulsification method.

The phase inversion emulsification method includes: dissolving a resin to be dispersed in a hydrophobic organic solvent in which the resin is soluble; conducting neutralization by adding a base to an organic continuous phase (O phase): and converting the resin (so-called phase inversion) from W/O to O/W by putting an aqueous medium (W phase) to form a discontinuous phase, thereby dispersing the resin as particles in the aqueous medium.

A volume average particle diameter of the resin particles dispersed in the resin particle dispersion is, for example, preferably 0.01 μm to 1 μm, more preferably 0.08 μm to 0.8 μm and even more preferably 0.1 μm to 0.6 μm.

Regarding the volume average particle diameter of the resin particles, a cumulative distribution by volume is drawn from the side of the smallest diameter with respect to particle diameter ranges (channels) separated using the particle diameter distribution obtained by the measurement with a laser diffraction-type particle diameter distribution measuring device (for example, LA-700 manufactured by Horiba, Ltd.), and a particle diameter in a case where the cumulative percentage becomes 50% with respect to the entire particles is measured as a volume average particle diameter D50v. The volume average particle diameter of the particles in other dispersions is also measured in the same manner.

The content of the resin particles contained in the resin particle dispersion is, for example, preferably 5% by weight to 50% by weight, and more preferably 10% by weight to 40% by weight.

In the resin particle dispersion preparation process, a dispersion is preferably prepared as follows. That is, as a mixed solution obtained by mixing each raw material of the styrene-acrylic resin which is the binder resin, a mixed solution of two or more kinds including a mixed solution ($LQ_L$) of di- or higher functional acrylate having a low concentration and a mixed solution ($LQ_H$) thereof having a high concentration is prepared. A resin particle which is a core is formed by firstly polymerizing the resin by using the mixed solution ($LQ_L$), and the mixed solution ($LQ_H$) is further added into the mixed solution, where the core is formed, and polymerized to form the resin particle. Accordingly, a resin particle having different degrees of formation of crosslinked structures in the inner portion and the surface is formed. By preparing the resin particle dispersion by the method, a percentage of the resin having a crosslinked structure on the surface side rather than the inner portion is high, that is, a dispersion including the resin particle having a high percentage of the resin having a high molecular weight on the surface side is obtained.

For example, the colorant particle dispersion and the release agent particle dispersion are also prepared in the same manner as in the case of the resin particle dispersion. That is, the particles in the resin particle dispersion are the same as the colorant particles dispersed in the colorant particle dispersion and the release agent particles dispersed in the release agent particle dispersion, in terms of the volume average particle diameter, the dispersion medium, the dispersing method, and the content of the particles.

Aggregated Particle Forming Process

Next, the colorant particle dispersion and the release agent dispersion are mixed together with the resin particle dispersion.

The resin particles, the colorant particles, and the release agent particles are heterogeneously aggregated in the mixed dispersion, thereby forming aggregated particles having a diameter near a target toner particle diameter and including the resin particles, the colorant particles, and the release agent particles.

Specifically, for example, an aggregating agent is added to the mixed dispersion and a pH of the mixed dispersion is adjusted to acidity (for example, the pH is 2 to 5). If necessary, a dispersion stabilizer is added. Then, the mixed dispersion is heated at a temperature of the glass transition temperature of the resin particles (specifically, for example, from a temperature 30° C. lower than the glass transition temperature of the resin particles to 10° C. lower than the glass transition temperature) to aggregate the particles dispersed in the mixed dispersion, thereby forming the aggregated particles.

In the aggregated particle forming process, for example, the aggregating agent may be added at room temperature (for example, 25° C.) under stirring of the dispersion mixture using a rotary shearing-type homogenizer, the pH of the dispersion mixture may be adjusted to be acidic (for example, the pH is 2 to 5), a dispersion stabilizer may be added if necessary, and then the heating may be performed.

Examples of the aggregating agent include a surfactant having an opposite polarity to the polarity of the surfactant used as the dispersing agent to be added to the mixed dispersion, an inorganic metal salt, and a di- or higher-valent metal complex. Particularly, in a case where a metal complex is used as the aggregating agent, the amount of the surfactant used is reduced and charging characteristics are improved.

If necessary, an additive may be used which forms a complex or a similar bond with the metal ions of the aggregating agent. A chelating agent is preferably used as the additive.

Examples of the inorganic metal salt include a metal salt such as calcium chloride, calcium nitrate, barium chloride, magnesium chloride, zinc chloride, aluminum chloride, and aluminum sulfate, and inorganic metal salt polymer such as polyaluminum chloride, polyaluminum hydroxide, and calcium polysulfide.

A water-soluble chelating agent may be used as the chelating agent. Examples of the chelating agent include oxycarboxylic acids such as tartaric acid, citric acid, and gluconic acid, iminodiacetic acid (IDA), nitrilotriacetic acid (NTA), and ethylenediaminetetraacetic acid (EDTA).

An addition amount of the chelating agent is, for example, preferably in a range of 0.01 parts by weight to 5.0 parts by weight, and more preferably in a range of 0.1 parts by weight to less than 3.0 parts by weight relative to 100 parts by weight of the resin particles.

Coalescence Process Next, the aggregated particle dispersion in which the aggregated particles are dispersed is heated at, for example, a temperature that is equal to or higher than the glass transition temperature of the resin particles (for example, a temperature that is higher than the glass transition temperature of the resin particles by 10° C. to 30° C.) to coalesce the aggregated particles and form toner particles.

Toner particles are obtained through the foregoing processes.

After the aggregated particle dispersion in which the aggregated particles are dispersed is obtained, toner particles may be produced through the processes of: further mixing the resin particle dispersion in which the resin particles are dispersed with the aggregated particle dispersion to conduct aggregation so that the resin particles further adhere to the surfaces of the aggregated particles, thereby forming second aggregated particles: and coalescing the second aggregated particles by heating the second aggregated particle dispersion in which the second aggregated particles are dispersed, thereby forming toner particles having a core/shell structure.

Here, after the coalescence process ends, the toner particles formed in the solution are subjected to a washing process, a solid-liquid separation process, and a drying process, that are well known, and thus dry toner particles are obtained.

In the washing process, preferably, displacement washing using ion exchange water is sufficiently performed from the viewpoint of charging properties. In addition, the solid-liquid separation process is not particularly limited, and suction filtration, pressure filtration, or the like may be performed from the viewpoint of productivity. The method for the drying process is also not particularly limited, and freeze drying, flush drying, fluidized drying, vibration-type fluidized drying, or the like may be performed from a viewpoint of productivity.

The toner according to the exemplary embodiment is, for example, produced by adding an external additive to the obtained dry toner particles and mixing the materials. The mixing may be performed by a V blender, a HENSCHEL MIXER, a Lödige mixer, and the like. Further, if necessary, coarse toner particles may be removed by a vibration classifier, a wind classifier, and the like.

Electrostatic Charge Image Developer

An electrostatic charge image developer according to the exemplary embodiment includes at least the toner according to the exemplary embodiment.

The electrostatic charge image developer according to the exemplary embodiment may be a single-component developer including only the toner according to the exemplary embodiment or may be a two-component developer obtained by mixing the toner and a carrier.

The carrier is not particularly limited and known carriers are exemplified. Examples of the carrier include a coating carrier in which surfaces of cores formed of magnetic particles are coated with a coating resin; magnetic particles dispersion-type carrier in which magnetic particles are dispersed and blended in a matrix resin: and a resin impregnation-type carrier in which porous magnetic particles are impregnated with a resin.

The magnetic particle dispersion-type carrier and the resin impregnation-type carrier may be carriers in which constituent particles of the carrier are cores and coated with a coating resin.

Examples of the magnetic particles include magnetic metals such as iron, nickel, and cobalt, and magnetic oxides such as ferrite and magnetite.

Examples of the resin for coating and matrix resin include polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylic acid ester copolymer, a straight silicone resin configured to include an organosiloxane bond or a modified product thereof, a fluorine resin, polyester, polycarbonate, a phenol resin, and an epoxy resin.

The coating resin and the matrix resin may contain other additives such as a conductive material.

Examples of the conductive particles include particles of metals such as gold, silver, and copper, carbon black particles, titanium oxide particles, zinc oxide particles, tin oxide particles, barium sulfate particles, aluminum borate particles, and potassium titanate particles.

Here, a coating method using a coating layer forming solution in which a coating resin, and if necessary, various additives are dissolved in an appropriate solvent is used to coat the surface of a core with the coating resin. The solvent is not particularly limited, and may be selected in consideration of the coating resin to be used, coating suitability, and the like.

Specific examples of the resin coating method include a dipping method of dipping cores in a coating layer forming solution, a spraying method of spraying a coating layer forming solution to surfaces of cores, a fluid bed method of spraying a coating layer forming solution in a state in which cores are allowed to float by flowing air, and a kneader-coater method in which cores of a carrier and a coating layer forming solution are mixed with each other in a kneader-coater and the solvent is removed.

The mixing ratio (weight ratio) between the toner and the carrier in the two-component developer is preferably 1:100 to 30:100, and more preferably 3:100 to 20:100 (toner: carrier).

Image Forming Apparatus and Image Forming Method

An image forming apparatus and an image forming method according to the exemplary embodiment will be described.

The image forming apparatus according to the exemplary embodiment is provided with an image holding member, a charging unit that charges a surface of the image holding member, an electrostatic charge image forming unit that forms an electrostatic charge image on the charged surface of the image holding member, a developing unit that contains a container that contains an electrostatic charge image developer and develops the electrostatic charge image formed on the surface of the image holding member with the electrostatic charge image developer as a toner image, a transfer unit that transfers the toner image formed onto the surface of the image holding member to a surface of a recording medium, and a fixing unit that fixes the toner image transferred onto the surface of the recording medium. As the electrostatic charge image developer, the electrostatic charge image developer according to the exemplary embodiment is applied.

In the image forming apparatus according to the exemplary embodiment, an image forming method (image forming method according to the exemplary embodiment) including the processes of: charging a surface of an image holding member: forming an electrostatic charge image on the charged surface of the image holding member; developing the electrostatic charge image formed on the surface of the image holding member with the electrostatic charge image developer according to the exemplary embodiment as a toner image; transferring the toner image formed onto the surface of the image holding member to a surface of a recording medium; and fixing the toner image transferred onto the surface of the recording medium is performed.

As the image forming apparatus according to the exemplary embodiment, a known image forming apparatus is applied, such as a direct transfer type apparatus that directly transfers a toner image formed on a surface of an image holding member onto a recording medium, an intermediate transfer type apparatus that primarily transfers a toner image formed on a surface of an image holding member onto a surface of an intermediate transfer member, and secondarily transfers the toner image transferred to the surface of the intermediate transfer member onto a surface of a recording medium; an apparatus that is provided with a cleaning unit that cleans a surface of an image holding member before charging after transfer of a toner image: or an apparatus that is provided with an erasing unit that irradiates, after transfer of a toner image, a surface of an image holding member with erase light before charging for erasing.

In the case of an intermediate transfer type apparatus, a transfer unit is configured to have, for example, an intermediate transfer member having a surface to which a toner image is to be transferred, a primary transfer unit that primarily transfers a toner image formed on a surface of an image holding member onto the surface of the intermediate transfer member, and a secondary transfer unit that secondarily transfers the toner image transferred onto the surface of the intermediate transfer member onto a surface of a recording medium.

In the image forming apparatus according to the exemplary embodiment, for example, a part including the developing unit may have a cartridge structure (process cartridge) that is detachable from the image forming apparatus. As the process cartridge, for example, a process cartridge that includes a container that contains the electrostatic charge image developer according to the exemplary embodiment and is provided with a developing unit is suitably used.

Hereinafter, an example of the image forming apparatus according to the exemplary embodiment will be shown. However, the image forming apparatus is not limited thereto. Main portions shown in the drawing will be described, but descriptions of other portions will be omitted.

Figure 3:
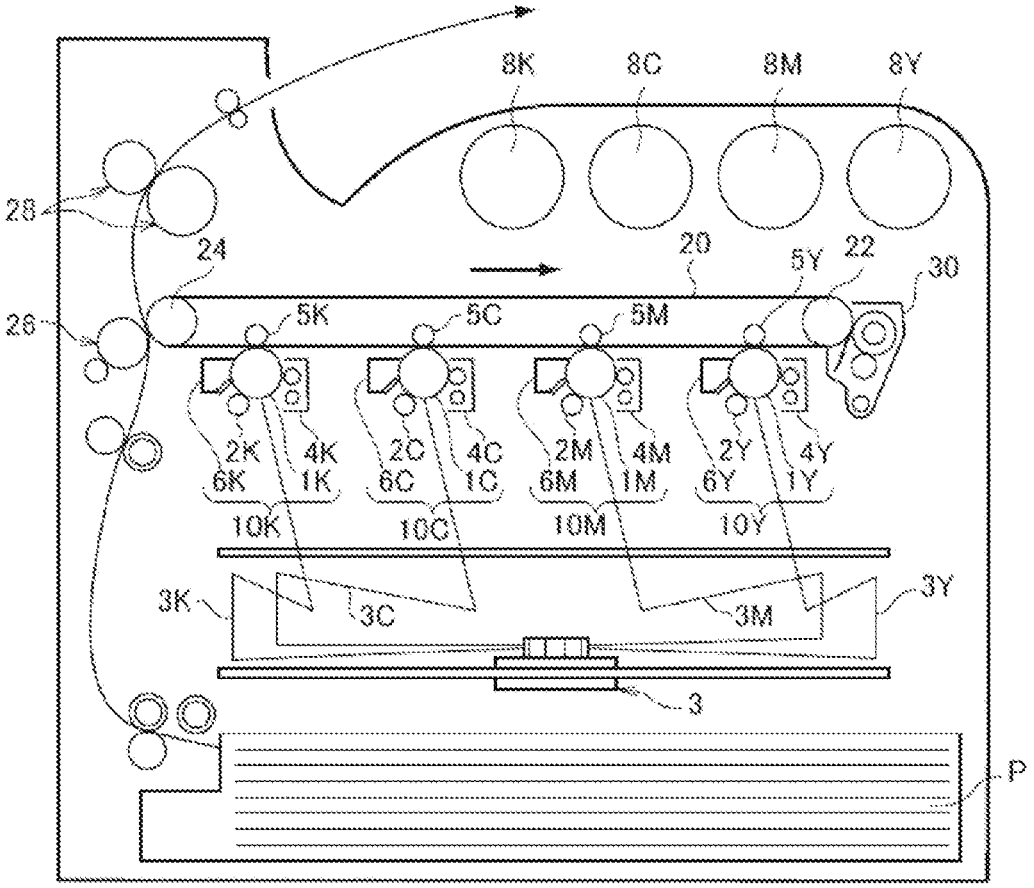
FIG. 3 is a configuration diagram showing an example of an image forming apparatus according to the exemplary embodiment.

FIG. 3 is a schematic configuration diagram showing the image forming apparatus according to the exemplary embodiment.

The image forming apparatus shown in FIG. 3 is provided with first to fourth electrophotographic image forming units 10Y, 10M, 10C, and 10K (image forming units) that output yellow(Y), magenta (M), cyan (C), and black (K) images based on color-separated image data, respectively. These image forming units (hereinafter, may be simply referred to as "units") 10Y, 10M, 10C, and 10K are arranged side by side at predetermined intervals in a horizontal direction. These units 10Y, 10M, 10C, and 10K may be process cartridges that are detachable from the image forming apparatus.

An intermediate transfer belt 20 as an intermediate transfer member is installed above the units 10Y, 10M, 10C, and 10K in the drawing to extend through the units. The intermediate transfer belt 20 is wound on a driving roll 22 and a support roll 24 contacting the inner surface of the intermediate transfer belt 20, which are disposed to be separated from each other on the left and right sides in the drawing, and travels in a direction toward the fourth unit 10K from the first unit 10Y. The support roll 24 is pressed in a direction in which it departs from the driving roll 22 by a spring or the like (not shown), and a tension is given to the intermediate transfer belt 20 wound on both of the rolls. In addition, an intermediate transfer member cleaning device 30 opposed to the driving roll 22 is provided on a surface of the intermediate transfer belt 20 on the image holding member side.

Developing devices (developing units) 4Y, 4M, 4C, and 4K of the units 10Y, 10M, 10C, and 10K are supplied with toner including four color toner, that is, a yellow toner, a magenta toner, a cyan toner, and a black toner accommodated in toner cartridges 8Y, 8M, 8C, and 8K, respectively.

The first to fourth units 10Y, 10M, 10C, and 10K have the same configuration, and accordingly, only the first unit 10Y that is disposed on the upstream side in a traveling direction of the intermediate transfer belt to form a yellow image will be representatively described here. The same parts as in the first unit 10Y will be denoted by the reference numerals with magenta (M), cyan (C), and black (K) added instead of yellow (Y), and descriptions of the second to fourth units 10M, 10C, and 10K will be omitted.

The first unit 10Y has a photoreceptor 10Y acting as an image holding member.

Around the photoreceptor 1Y, a charging roll (an example of the charging unit) 2Y that charges a surface of the photoreceptor 1Y to a predetermined potential, an exposure device (an example of the electrostatic charge image forming unit) 3 that exposes the charged surface with laser beams 3Y based on a color-separated image signal to form an electrostatic charge image, a developing device (an example of the developing unit) 4Y that supplies a charged toner to the electrostatic charge image to develop the electrostatic charge image, a primary transfer roll (an example of the primary transfer unit) 5Y that transfers the developed toner image onto the intermediate transfer belt 20, and a photoreceptor cleaning device (an example of the cleaning unit) 6Y that removes the toner remaining on the surface of the photoreceptor 1Y after primary transfer, are arranged in sequence.

The primary transfer roll 5Y is disposed inside the intermediate transfer belt 20 to be provided at a position opposed to the photoreceptor 1Y. Furthermore, bias supplies (not shown) that apply a primary transfer bias are connected to the primary transfer rolls 5Y, 5M, 5C, and 5K, respectively. Each bias supply changes a transfer bias that is applied to each primary transfer roll under the control of a controller (not shown).

Hereinafter, an operation of forming a yellow image in the first unit 10Y will be described.

First, before the operation, the surface of the photoreceptor 1Y is charged to a potential of −600 V to −800 V by the charging roll 2Y The photoreceptor 1Y is formed by laminating a photosensitive layer on a conductive substrate (for example, volume resistivity at 20° C.: $1\times10^{-6}$ Ωcm or less). The photosensitive layer typically has high resistance (that is about the same as the resistance of a general resin), but has properties in which, in a case where laser beams 3Y are applied, the specific resistance of a part irradiated with the laser beams changes. Accordingly, the laser beams 3Y are output to the charged surface of the photoreceptor 1Y via the exposure device 3 in accordance with image data for yellow sent from the controller (not shown). The laser beams 3Y are applied to the photosensitive layer on the surface of the photoreceptor 1Y, whereby an electrostatic charge image of a yellow image pattern is formed on the surface of the photoreceptor 1Y.

The electrostatic charge image is an image that is formed on the surface of the photoreceptor 1Y by charging, and is a so-called negative latent image, that is formed by irradiating the photosensitive layer with laser beams 3Y so that the specific resistance of the irradiated part is lowered to cause charges to flow on the surface of the photoreceptor 1Y, while charges stay on a part which is not irradiated with the laser beams 3Y.

The electrostatic charge image formed on the photoreceptor 1Y is rotated up to a predetermined developing position with the travelling of the photoreceptor 1Y. The electrostatic charge image on the photoreceptor 1Y is visualized (developed) as a toner image at the developing position by the developing device 4Y.

The developing device 4Y accommodates, for example, an electrostatic charge image developer including at least a yellow toner and a carrier. The yellow toner is frictionally charged by being stirred in the developing device 4Y to have a charge with the same polarity (negative polarity) as the charge that is on the photoreceptor 1Y, and is thus held on the developer roll (an example of the developer holding member). By allowing the surface of the photoreceptor 1Y to pass through the developing device 4Y, the yellow toner electrostatically adheres to the erased latent image part on the surface of the photoreceptor 1Y, whereby the latent image is developed with the yellow toner. Next, the photoreceptor 1Y having the yellow toner image formed thereon continuously travels at a predetermined rate and the toner image developed on the photoreceptor 1Y is transported to a predetermined primary transfer position.

In a case where the yellow toner image on the photoreceptor 1Y is transported to the primary transfer position, a primary transfer bias is applied to the primary transfer roll 5Y and an electrostatic force toward the primary transfer roll 5Y from the photoreceptor 1Y acts on the toner image, whereby the toner image on the photoreceptor 1Y is transferred onto the intermediate transfer belt 20. The transfer bias applied at this time has the opposite polarity (+) to the toner polarity (−), and, for example, is controlled to +10 μA in the first unit 10Y by the controller (not shown).

On the other hand, the toner remaining on the photoreceptor 1Y is removed and collected by the photoreceptor cleaning device 6Y.

The primary transfer biases that are applied to the primary transfer rolls 5M, 5C, and 5K of the second unit 10M and the subsequent units are also controlled in the same manner as in the case of the first unit.

In this manner, the intermediate transfer belt 20 onto which the yellow toner image is transferred in the first unit 10Y is sequentially transported through the second to fourth units 10M, 10C, and 10K, and the toner images of respective colors are multiply-transferred in a superimposed manner.

The intermediate transfer belt 20 onto which the four color toner images have been multiply-transferred through the first to fourth units reaches a secondary transfer part that is composed of the intermediate transfer belt 20, the support roll 24 contacting the inner surface of the intermediate transfer belt, and a secondary transfer roll (an example of the secondary transfer unit) 26 disposed on the image holding surface side of the intermediate transfer belt 20. Meanwhile, a recording sheet (an example of the recording medium) P is supplied to a gap between the secondary transfer roll 26 and the intermediate transfer belt 20, that are brought into contact with each other, via a supply mechanism at a predetermined timing, and a secondary transfer bias is applied to the support roll 24. The transfer bias applied at this time has the same polarity (−) as the toner polarity (−), and an electrostatic force toward the recording sheet P from the intermediate transfer belt 20 acts on the toner image, whereby the toner image on the intermediate transfer belt 20 is transferred onto the recording sheet P. In this case, the secondary transfer bias is determined depending on the resistance detected by a resistance detector (not shown) that detects the resistance of the secondary transfer part, and is voltage-controlled.

Thereafter, the recording sheet P is fed to a nip portion between a pair of fixing rolls in a fixing device (an example of the fixing unit) 28 so that the toner image is fixed to the recording sheet P, whereby a fixed image is formed.

Examples of the recording sheet P onto which a toner image is transferred include plain paper that is used in electrophotographic copying machines, printers, and the like. As a recording medium, an OHP sheet is also exemplified other than the recording sheet P.

The surface of the recording sheet P is preferably smooth in order to further improve smoothness of the image surface after fixing. For example, coated paper obtained by coating a surface of plain paper with a resin or the like, art paper for printing, and the like are preferably used.

The recording sheet P on which the fixing of the color image is completed is discharged toward a discharge part, and a series of the color image forming operations end.

Process Cartridge/Toner Cartridge

A process cartridge according to the exemplary embodiment will be described.

The process cartridge according to the exemplary embodiment includes a developing unit that includes a container that contains the electrostatic charge image developer according to the exemplary embodiment and develops an electrostatic charge image formed on a surface of an image holding member with the electrostatic charge image developer as a toner image, and is detachable from an image forming apparatus.

The process cartridge according to the exemplary embodiment is not limited to the above-described configuration, and may be configured to include a developing device, and if necessary, at least one selected from other units such as an image holding member, a charging unit, an electrostatic charge image forming unit, and a transfer unit.

Hereinafter, an example of the process cartridge according to the exemplary embodiment will be shown. However, the process cartridge is not limited thereto. Major parts shown in the drawing will be described, but descriptions of other parts will be omitted.

Figure 4:
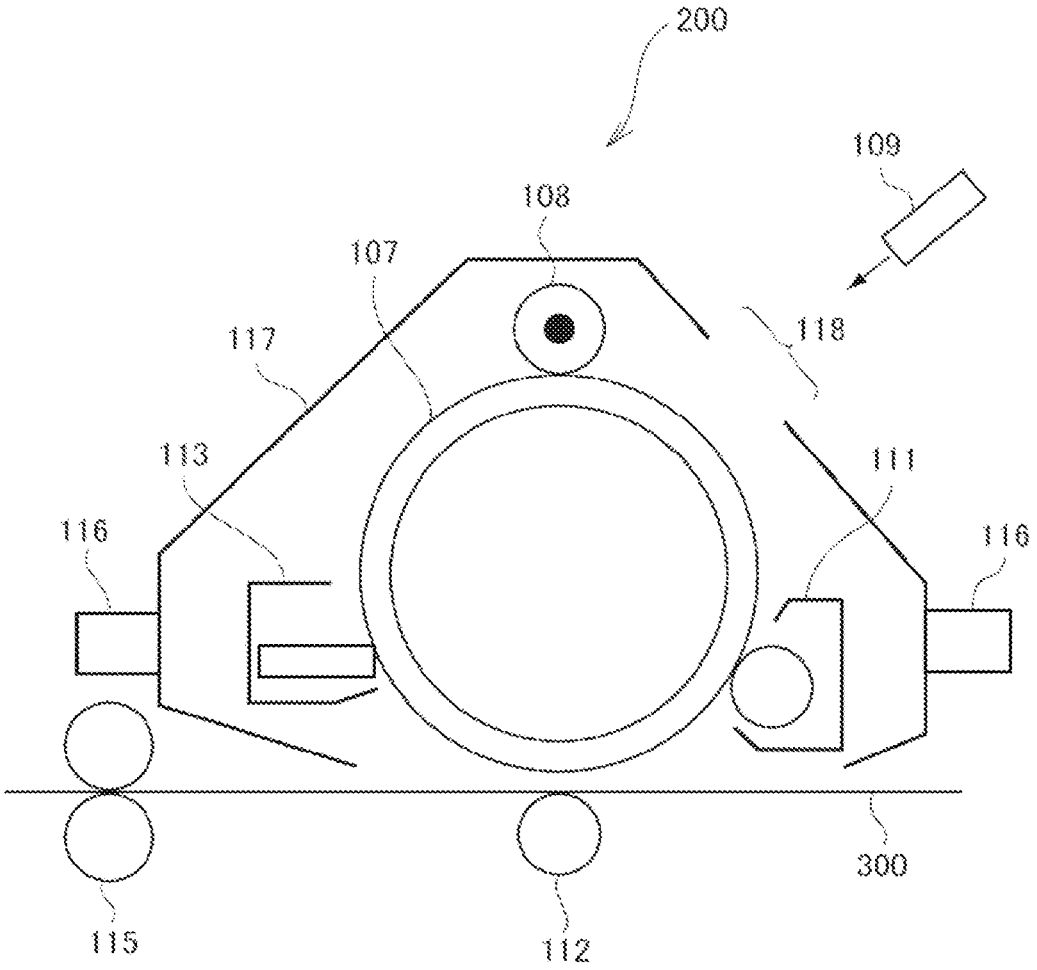
FIG. 4 is a configuration diagram showing an example of a process cartridge according to the exemplary embodiment.

FIG. 4 is a schematic configuration diagram showing the process cartridge according to the exemplary embodiment.

A process cartridge 200 shown in FIG. 4 is formed as a cartridge having a configuration in which a photoreceptor 107 (an example of the image holding member), a charging roll 108 (an example of the charging unit), a developing device 111 (an example of the developing unit), and a photoreceptor cleaning device 113 (an example of the cleaning unit), which are provided around the photoreceptor 107, are integrally combined and held by the use of, for example, a housing 117 provided with a mounting rail 116 and an opening 118 for exposure.

In FIG. 4, the reference numeral 109 represents an exposure device (an example of the electrostatic charge image forming unit), the reference numeral 112 represents a transfer device (an example of the transfer unit), the reference numeral 115 represents a fixing device (an example of the fixing unit), and the reference numeral 300 represents a recording sheet (an example of the recording medium).

Next, a toner cartridge according to the exemplary embodiment will be described.

The toner cartridge according to the exemplary embodiment includes a container that contains the toner according to the exemplary embodiment and is detachable from an image forming apparatus. The toner cartridge includes a container that contains a toner for replenishment for being supplied to the developing unit provided in the image forming apparatus.

The image forming apparatus shown in FIG. 3 has such a configuration that the toner cartridges 8Y, 8M, 8C, and 8K are detachable therefrom, and the developing devices 4Y, 4M, 4C, and 4K are connected to the toner cartridges corresponding to the respective developing devices (colors) via toner supply tubes (not shown), respectively. In addition, in a case where the toner accommodated in the toner cartridge runs low, the toner cartridge is replaced.

EXAMPLES

Hereinafter, Embodiment X will be described in detail using examples, but the exemplary embodiment is not limited to the following examples, as long as it does not depart from the scope thereof.

Hereinafter, "part" is based on weight, unless otherwise noted.

Example 1

Preparation of Resin Particle Dispersion (A1)

Styrene: 100 parts
n-butyl acrylate: 30 parts
β-carboxyethyl acrylate: 3 parts
1,10-decanediol diacrylate (polyfunctional acrylate): 0.27 parts
Dodecanethiol (DDT): 1 part A solution obtained by dissolving 4 parts of an anionic surfactant (DOWFAX manufactured by The Dow Chemical Company) in 550 parts of ion exchange water is put into a flask, and a mixed solution (A1) obtained by mixing the raw materials described above is put thereto and emulsified. While gently stirring the emulsified solution for 10 minutes, 50 parts of ion exchange water where 6 parts of ammonium persulfate is dissolved is put thereto. Then, nitrogen substitution in the system is sufficiently performed, the temperature is increased by oil bath such that the temperature of the inner system becomes 75° C., and polymerization is performed for 30 minutes. This is designated as a core particle dispersion (A1).

Styrene: 210 parts
n-butyl acrylate: 70 parts
β-carboxyethyl acrylate: 6 parts
1,10-decanediol diacrylate (polyfunctional acrylate): 2.3 parts
Dodecanethiol (DDT): 2 parts Next, a mixed solution (A2) obtained by mixing the raw materials described above is stirred and emulsified, and thus, the emulsified solution is obtained. The emulsified solution is added to the core particle dispersion (A1) over 120 minutes and emulsion polymerization is continued as it is for 4 hours. Accordingly, a resin particle dispersion in which styrene-acrylic resin particles having a weight average molecular weight Mw of 33,000, a glass transition temperature of 53 degrees, and a volume average particle diameter of 250 nm are dispersed is obtained. Ion exchange water is added to the resin particle dispersion such that the solid content is adjusted to 20% by weight, and thus, the resin particle dispersion (A1) is obtained.

As described above, a method of preparing two kinds of the mixed solutions (mixed solutions (A1) and (A2)) obtained by mixing the raw materials described above, and separately adding the mixed solutions of the raw materials in two stages is referred to as a two-step addition method.

Preparation of Magenta Colorant Dispersion

PR122 (manufactured by Dainichiseika Color & Chemicals Mfg. Co., Ltd., CHROMOFINE MAGENTA 6887): 70 parts Anionic surfactant (manufactured by DKS Co., Ltd., NEOGEN RK): 1 part Ion exchange water: 200 parts The above materials are mixed with each other, and dispersed by a homogenizer (ULTRA TURRAX T50 manufactured by IKA Works, Inc.) for 10 minutes. Ion exchange water is added such that the solid content in the dispersion becomes 20% by weight, and thus, a colorant dispersion in which colorant particles having a volume average particle diameter of 190 nm are dispersed is obtained.

Preparation of Release Agent Dispersion

Paraffin Wax (manufactured by Nippon Seiro Co., Ltd., HNP-9): 100 parts

Anionic surfactant (manufactured by DKS Co., Ltd., NEOGEN RK): 1 part

Ion exchange water: 350 parts

The above materials are mixed with each other, heated to 100° C., and dispersed using a homogenizer (ULTRA TURRAX T50 manufactured by IKA Works, Inc.). After that, the mixture is subject to dispersion treatment with MANTON-GAULIN HIGH PRESSURE HOMOGENIZER (manufactured by Gaulin Co., Ltd.), and thus, a release agent dispersion (solid content of 20% by weight) in which release agent particles having a volume average particle diameter of 200 nm are dispersed is obtained.

Preparation of Toner (A1)

Ion exchange water: 185 parts

Resin particle dispersion (A1): 190 parts

Magenta colorant dispersion: 35 parts

Release agent dispersion: 40 parts

Anionic surfactant (TaycaPower): 2.8 parts

The above components are put in a 3-liter reaction vessel including a thermometer, a pH meter, and a stirrer, and held at a temperature of 30° C. at a stirring rotation rate of 150 rpm for 30 minutes, while controlling the temperature with a mantle heater from the outside.

A PAC aqueous solution in which 0.7 parts of PAC (manufactured by Oji Paper Co., Ltd.: 30% powder product) is dissolved in 7 parts of ion exchange water is added, while stirring with a homogenizer (manufactured by IKA Works, Inc.: ULTRA TURRAX T50).

After that, the temperature is increased to 50° C., a particle diameter is measured using a COULTER MULTISIZER II (aperture diameter: 50 μm, manufactured by Beckman Coulter, Inc.), and a volume average particle diameter is 5.0 μm. Then, 93 parts of the resin particle dispersion (A1) is additionally added, so that the resin particles are attached (shell structure) to the surfaces of the aggregated particles.

After adding 20 parts of 10% by weight of nitrilotriacetic acid (NTA) metal salt solution (CHELEST 70: manufactured by Chelest Corporation) thereto, the pH is adjusted to 9.0 using IN sodium hydroxide aqueous solution. Then, the temperature is increased to 90° C. at a rate of temperature increase of 0.05° C./min, the temperature is maintained at 90° C. for 3 hours, and then the mixture is cooled and filtered, thereby obtaining coarse toner particles. The coarse toner particles are further re-dispersed in ion exchange water, repeatedly filtered, and washed such that electric conductivity of the filtrate becomes 20 μS/cm or less, and then subjected to vacuum-drying in an oven at 40° C. for 5 hours, and thus, toner particles are prepared.

1.5 parts by weight of hydrophobic silica (manufactured by Nippon Aerosil Co. Ltd., RY50) and 1.0 part by weight of hydrophobic titanium oxide (manufactured by Nippon Aerosil Co. Ltd., T805) are mixed with respect to 100 parts by weight of the obtained toner particles by a sample mill at 10,000 rpm for 30 seconds. After that, the mixture is sieved by a vibration sieving device having an aperture of 45 μm, and thus, a toner (A1) is prepared. A volume average particle diameter of the obtained toner (A1) is 6.1 μm.

Preparation of Developer (A1)

Ferrite particles (average particle diameter of 50 μm): 100 parts

Toluene: 14 parts

A styrene-methyl methacrylate copolymer: (copolymerization ratio: 15/85): 2 parts Carbon black: 0.2 parts The above components excluding the ferrite particles are dispersed by a sand mill to prepare a dispersion, the dispersion and the ferrite particles are put into a vacuum degassing type kneader and dried while stirring under the reduced pressure, and thus, a carrier is obtained.

5 parts of the toner (A1) is mixed with 100 parts of the carrier, and thus, a developer (A1) is obtained.

Examples 2 to 17

Toners and developers are produced in the same manner as in Example 1, except that the blending ratio (% by weight) of "dodecane thiol (DDT) in the first stage and the second stage of the two-step addition method, the blending ratio (% by weight) of "polyfunctional acrylate" in the first stage and the second stage, and the kind of"polyfunctional acrylate" used are changed as shown in Table 1.

Comparative Examples 1 to 4

Toners and developers are produced in the same manner as in the preparation of the resin particle dispersion in Example 1, except that the blending ratio (% by weight) of "dodecane thiol (DDT) in the first stage and the second stage of the two-step addition method, the blending ratio (% by weight) of "polyfunctional acrylate" in the first stage and the second stage, and the kind of"polyfunctional acrylate" used are changed as shown in Table 1.

In Comparative Example 1, polyfunctional acrylate is not used.

Comparative Example 5

A toner and a developer are produced in the same manner as in Example 1, except that the resin particle dispersion used is changed to a resin particle dispersion (B5) prepared as follows.

Preparation of Resin Particle Dispersion (B5)

Styrene: 310 parts n-butyl acrylate: 100 parts

β-carboxyethyl acrylate: 9 parts 1,10-decanediol diacrylate (polyfunctional acrylate): 2.1 parts Dodecanethiol (DDT): 3.2 parts A solution obtained by dissolving 4 parts of an anionic surfactant (DOWFAX manufactured by The Dow Chemical Company) in 550 parts of ion exchange water is put into a flask, and a mixed solution (B5) obtained by mixing the raw materials described above is put thereto and emulsified. While gently stirring the emulsified solution for 10 minutes, 50 parts of ion exchange water where 6 parts of ammonium persulfate is dissolved is put thereto. Then, nitrogen substitution in the system is sufficiently performed, the temperature is increased by oil bath such that the temperature of the inner system becomes 75° C., and emulsion polymerization is continued for 4 hours. Accordingly, a resin particle dispersion in which resin particles having a weight average molecular weight Mw of 33,000, a glass transition temperature of 53° C., and a volume average particle diameter of 250 nm are dispersed is obtained. Ion exchange water is added to the resin particle dispersion, the solid content is adjusted to 20% by weight, and thus, the resin particle dispersion (B5) is obtained.

As described above, a method of preparing only one kind of the mixed solution (mixed solution (B5)) obtained by mixing the raw materials, and adding the mixed solution of the raw materials at once is referred to as a one-step addition method.

Comparative Example 6

A toner and a developer are produced in the same manner as in Comparative Example 5, except that the blending ratio (% by weight) of "dodecane thiol (DDT) and the blending ratio (% by weight) of "polyfunctional acrylate" in the one-step addition method are changed as shown in Table 1.

Measurement of Physical Properties

Regarding the toners obtained in the examples and the comparative examples, the molecular weight distribution curve is created by the method described above, and "b/a" and "(b/a)/(b'/a')" are calculated. In addition, the "z average molecular weight Mz", the "number average molecular weight Mn", and the "ratio (Mz/Mn)" are calculated.

Further, the "content of the component insoluble in tetrahydrofuran (THF insoluble component) excluding a pigment, a release agent, and an external additive", the "difference (T2−T1) between the endothermic peak temperature T1 of the release agent at the time of heating of differential scanning calorimetry (DSC) and the exothermic peak temperature T2 of the release agent at the time of cooling after the heating", and the "BET specific surface area" are measured by the methods described above.

Other values of physical properties are measured by the following method.

Weight Average Molecular Weight Mw of Resin

The weight average molecular weight of the resin is calculated from a result of the molecular weight measurement performed by gel permeation chromatography (GPC) using the following measurement device and a calibration curve of molecular weight obtained with a monodisperse polystyrene standard sample.

Measurement device: HLC-8120 (manufactured by Tosoh Corporation)

Column: TSKgel SUPER HM-M (manufactured by Tosoh Corporation)

Eluent: tetrahvdrofuran

Glass Transition Temperature of Resin

The glass transition temperature of the resin is obtained from the DSC curve obtained by differential scanning calorimetry (DSC), based on "Testing Methods for Transition Temperatures of Plastics" in JIS K-7121-1987.

Volume Average Particle Diameter of Resin Particles and Toner Particles

A measurement method of the volume average particle diameter of the resin particles and the toner particles is as follows.

Case where Particle Diameter is 2 μm or More

Sample for measurement: 0.5 mg to 50 mg of the particles are added to 2 mL of an aqueous solution having 5% by weight of sodium dodecyl benzene sulfonate (surfactant), this is added to 100 mL to 150 mL of an electrolyte (ISOTON-II manufactured by Beckman Coulter, Inc.), a dispersion treatment is performed using an ultrasonic disperser for 1 minute, and thus, the sample is prepared.

Measurement device: COULTER MULTISIZER II (manufactured by Beckman Coulter, Inc.), aperture diameter of 100 μm Particle diameters of 50,000 particles having a particle diameter of 2 μm to 60 μm are measured by the sample for measurement and the measurement device, and the volume average particle diameter distribution is obtained from the particle diameter distribution.

Cumulative distributions by volume are drawn from the side of the smallest diameter with respect to particle diameter ranges (channels) separated based on the particle diameter distribution, and the particle diameter in a case where the cumulative percentage becomes 50% is defined as that corresponding to a volume average particle diameter.

Case Where Particle Diameter is less than 2 μm

Sample for measurement: ion exchange water is added to the particle dispersion such that the amount of the solid content is adjusted to 10% by weight.

Measurement device: laser diffraction-type particle diameter distribution measuring device (LS13320 manufactured by Beckman Coulter, Inc.)

The sample for measurement is added to a cell so as to achieve such a suitable concentration that scattering intensity becomes a value sufficient for the measurement, followed by the measurement. Cumulative distributions by volume are drawn from the side of the smallest diameter with respect to particle diameter ranges (channels) separated based on the obtained particle diameter distribution, and the particle diameter in a case where the cumulative percentage becomes 50% is defined as that corresponding to a volume average particle diameter.

Evaluation Test

Evaluation of Difference in Glossiness

A developing unit of a modified device of "DocuCentre color 400 manufactured by Fuji Xerox Co., Ltd." of an image forming apparatus is filled with each developer obtained in the examples and the comparative examples. By the image forming apparatus, in an environment of a temperature of 35° C. and a humidity of 85% RH, one sheet of the test chart No. 5-1 of The Imaging Society of Japan is printed on embossed paper (manufactured by Oji Paper Co., Ltd., product name: OK embossed texture (84.9 g/m$^2$)). After that, 3,000 sheets of solid images having image density of 100% (image having toner applied amount (TMA) of 14.4 g/m$^2$) are printed on the embossed paper, and then, the test chart No. 5-1 of The Imaging Society of Japan is printed on the embossed paper, again.

Regarding the (first) test chart No. 5-1 of The Imaging Society of Japan before printing 3,000 sheets and the test chart No. 5-1 of The Imaging Society of Japan after printing 3,000 sheets, the glossiness of the densest image portion of a magenta portion is measured by the following method.

The measurement of 60 degree glossiness is performed by a portable glossmeter (BYK GARDNER MICRO-TRI GLOSS METER manufactured by Toyo Seiki Seisaku-Sho).

The same evaluation is performed for every 1,000 sheets until the printing of 10,000-th sheet, and the number of sheets in stages where a difference in glossiness exceeds 5° is evaluated. In a case where a difference in glossiness exceeds 5° until the printing of 10,000-th sheet, "10,000<" is noted, and no more evaluation is performed.

A case where a difference in glossiness does not exceed 5° until the printing of 3,000 sheet is set as an acceptable range.

From the results, it is found that, in the toner of the examples in which the conditions of the z average molecular weight Mz of 80,000 to 400,000 and "b/a" of the molecular weight distribution curve of 1.3 to 2.0 are satisfied, the occurrence of a difference in glossiness of the images before and after repeatedly forming high-density images is prevented, as compared with the toner of the comparative examples in which at least one of the z average molecular weight Mz and "b/a" is beyond the ranges described above.

Hereinafter, Embodiment A will be described in detail using examples, but the exemplary embodiment is not

TABLE 1

| | | Resin particle dispersion preparing method | DDT blending ratio [% by weight] First stage | DDT blending ratio [% by weight] Second stage | Polyfunctional acrylate blending ratio [% by weight] First stage | Polyfunctional acrylate blending ratio [% by weight] Second stage | Polyfunctional acrylate |
|---|---|---|---|---|---|---|---|
| Example | 1 | Two-step addition method | 1.5 | 0.69 | 0.2 | 0.8 | 1,10-dodecanediol diaetylate |
| | 2 | Two-step addition method | 1.4 | 0.69 | 0.3 | 1.2 | |
| | 3 | Two-step addition method | 1.2 | 0.69 | 0.4 | 1.6 | |
| | 4 | Two-step addition method | 0.95 | 0.69 | 1.0 | 3.0 | |
| | 5 | Two-step addition method | 0.74 | 0.69 | 1.6 | 5.0 | |
| | 6 | Two-step addition method | 1.3 | 0.5 | 0.2 | 0.8 | |
| | 7 | Two-step addition method | 1.1 | 0.5 | 0.3 | 1.2 | |
| | 8 | Two-step addition method | 0.5 | 0.5 | 0.8 | 3.0 | |
| | 9 | Two-step addition method | 1.4 | 1.0 | 0.3 | 1.2 | |
| | 10 | Two-step addition method | 1.0 | 1.0 | 0.6 | 2.4 | |
| | 11 | Two-stcp addition method | 1.0 | 1.0 | 1.0 | 3.0 | |
| | 12 | Two-step addition method | 1.0 | 1.0 | 1.6 | 5.0 | |
| | 13 | Two-step addition method | 0.74 | 0.69 | 0.2 | 0.8 | pentaerythritol triacrylate |
| | 14 | Two-step addition method | 0.74 | 0.69 | 0.2 | 0.8 | ditrimethylolpropane tetraacrylate |
| | 15 | Two-step addition method | 0.74 | 0.69 | 1.0 | 3.0 | pentaerythritol triacrylate |
| | 16 | Two-step addition method | 0.74 | 0.69 | 1.0 | 3.0 | ditrimethylolpropane tetraacrylate |
| Comparative Example | 1 | Two-step addition method | 0.74 | 0.69 | — | — | — |
| | 2 | Two-step addition method | 0.8 | 0.7 | 2.0 | 6.0 | 1,10-dodecariedioldiacrate |
| | 3 | Two-step addition method | 1.2 | 1.2 | 0.2 | 0.8 | |
| | 4 | Two-step addition method | 0.5 | 0.5 | 0.1 | 0.4 | |
| | 5 | One-step addition method | 0.75 | 0.5 | | | |
| | 6 | One-step addition method | 0.75 | 2.0 | | | |

TABLE 2

| | | Expression (1) b/a | Expression (2) (b/a)/(b'/a') | Mz | Mn | Mz/Mn | THF insoluble component | BET specific surface area ($m^2/g$) | Release agent [T2-T1] | Evaluation Number of sheets where difference in glossiness exceeds 5° |
|---|---|---|---|---|---|---|---|---|---|---|
| Example | 1 | 1.32 | 1.05 | 82,000 | 7,700 | 10.6 | 0.6% | 1.58 | 8.6° C. | 4000 |
| | 2 | 1.4 | 1.11 | 122,000 | 10,200 | 12.0 | 2.4% | 1.74 | 9.2° C. | 7000 |
| | 3 | 1.61 | 1.43 | 197,000 | 12,800 | 15.4 | 5.3% | 1.98 | 9.6° C. | 10000< |
| | 4 | 1.76 | 1.55 | 283,000 | 14,400 | 19.7 | 7.2% | 2.21 | 9.8° C. | 8000 |
| | 5 | 1.97 | 1.77 | 386,000 | 16,300 | 23.7 | 9.1% | 2.33 | 9.8° C. | 5000 |
| | 6 | 1.35 | 1.06 | 132,000 | 10,200 | 12.9 | 1.3% | 1.68 | 9.5° C. | 5000 |
| | 7 | 1.52 | 1.24 | 192,000 | 11,700 | 16.4 | 4.5% | 1.88 | 9.7° C. | 10000< |
| | 8 | 1.82 | 1.66 | 393,000 | 15,800 | 24.9 | 8.1% | 2.34 | 10.4° C. | 5000 |
| | 9 | 1.37 | 1.08 | 90,000 | 10,200 | 8.8 | 1.3% | 1.62 | 8.8° C. | 4000 |
| | 10 | 1.43 | 1.15 | 152,000 | 12,400 | 12.3 | 3.3% | 1.77 | 9.6° C. | 9000 |
| | 11 | 1.62 | 1.45 | 198,000 | 13,500 | 14.7 | 5.2% | 1.88 | 9.6° C. | 10000< |
| | 12 | 1.95 | 1.74 | 193,000 | 14,700 | 19.9 | 7.5% | 2.27 | 9.7° C. | 6000 |
| | 13 | 1.45 | 1.17 | 187,000 | 13,200 | 14.2 | 4.2% | 1.81 | 9.6° C. | 9000 |
| | 14 | 1.62 | 1.43 | 267,000 | 14,500 | 18.4 | 6.3% | 1.96 | 9.6° C. | 10000 |
| | 15 | 1.78 | 1.58 | 314,000 | 15,300 | 20.5 | 8% | 2.21 | 9.8° C. | 7000 |
| | 16 | 1.96 | 1.78 | 375,000 | 16,200 | 23.1 | 10% | 2.3 | 10.1° C. | 5000 |
| Comparative Example | 1 | 1.18 | 1.02 | 72,000 | 6,800 | 10.6 | 0.2% | 1.71 | 9.6° C. | 3000 |
| | 2 | 2.13 | 1.92 | 413,000 | 16,200 | 25.5 | 10.3% | 2.57 | 11.8° C. | 3000 |
| | 3 | 1.32 | 1.05 | 72,000 | 7,200 | 10.0 | 0.6% | 1.72 | 9.6° C. | 3000 |
| | 4 | 1.23 | 1.03 | 87,000 | 7,800 | 11.2 | 0.4% | 1.75 | 9.6° C. | 3000 |
| | 5 | 1.22 | 1.03 | 76,000 | 7,300 | 10.4 | 0.4% | 1.74 | 9.6° C. | 3000 |
| | 6 | 1.28 | 1.04 | 218,000 | 13,000 | 16.8 | 3.2% | 2.53 | 12.2° C. | 3000 |

limited to the following examples, as long as it does not depart from the scope thereof.

Hereinafter, "part" is based on weight, unless otherwise noted.

Example 1A

Preparation of Resin Particle Dispersion 1

Styrene: 100 parts n-butyl acrylate: 30 parts

β-carboxyethyl acrylate: 3 parts 1,6-hexanediol diacrylate (polyfunctioinal acrylate): 0.5 parts Dodecanethiol: 0.75 part A solution obtained by dissolving 4 parts of an anionic surfactant (DOWFAX manufactured by The Dow Chemical Company) in 550 parts of ion exchange water is put into a flask, and a mixed solution 1A obtained by mixing the raw materials described above is put thereto and emulsified. While gently stirring the emulsified solution for 10 minutes, 50 parts of ion exchange water where 6 parts of ammonium persulfate is dissolved is put thereto. Then, nitrogen substitution in the system is sufficiently performed, the temperature is increased by oil bath such that the temperature of the inner system becomes 75° C., and polymerization is performed for 30 minutes. This is designated as a core particle dispersion 1.

Styrene: 210 parts n-butyl acrylate: 70 parts

β-carboxyethyl acrylate: 6 parts 1,6-hexanediol diacrylate (polyfunctioinal acrylate): 3.5 parts Dodecanethiol: 2 parts Next, a mixed solution 1B obtained by mixing the raw materials described above is stirred and emulsified, and thus, the emulsified solution is obtained. The emulsified solution is added to the core particle dispersion 1 over 120 minutes and emulsion polymerization is continued as it is for 4 hours. Accordingly, a resin particle dispersion in which styrene-acrylic resin particles having a volume average particle diameter of 250 nm are dispersed is obtained. Ion exchange water is added to the resin particle dispersion such that the solid content is adjusted to 20% by weight, thereby obtaining the resin particle dispersion 1.

Preparation of Magenta Colorant Particle Dispersion

C.I. Pigment Red 122: 50 parts

Anionic surfactant (manufactured by DKS Co., Ltd., NEOGEN RK): 5 parts

Ion exchange water: 192.9 parts

The above components are mixed with each other and subjected to a process by ULTIMIZER (manufactured by Sugino Machine, Ltd.) at 240 MPa for 10 minutes, and thus, a magenta colorant particle dispersion (solid content concentration: 20%) is prepared.

Preparation of Release Agent Particles Dispersion

Paraffin Wax (manufactured by Nippon Seiro Co., Ltd., HNP-9): 100 parts

Anionic surfactant (manufactured by DKS Co., Ltd., NEOGEN RK): 1 part

Ion exchange water: 350 parts

The above materials are mixed with each other, heated to 100° C., and dispersed using a homogenizer (ULTRA TURRAX T50 manufactured by IKA Works, Inc.). After that, the mixture is subject to dispersion treatment with MANTON-GAULIN HIGH PRESSURE HOMOGENIZER (manufactured by Gaulin Co., Ltd.), and thus, a release agent particle dispersion (solid content of 20% by weight) in which release agent particles having a volume average particle diameter of 200 nm are dispersed is obtained.

Preparation of Toner Particles 1

Ion exchange water: 185 parts

Resin particle dispersion 1: 190 parts

Magenta colorant particle dispersion: 30 parts

Release agent dispersion: 35 parts

Anionic surfactant: 2.8 parts

The above components are put in a 3-liter reaction vessel including a thermometer, a pH meter, and a stirrer, and held at a temperature of 30° C. at a stirring rotation rate of 150 rpm for 30 minutes, while controlling the temperature with a mantle heater from the outside.

A PAC aqueous solution in which 0.7 parts of PAC (manufactured by Oji Paper Co., Ltd.: 30% powder product) is dissolved in 7 parts of ion exchange water is added, while stirring with a homogenizer (manufactured by IKA Works, Inc.: ULTRA TURRAX T50). After that, the temperature is increased to 50° C., a particle diameter is measured using a COULTER MULTISIZER II (aperture diameter: 50 μm, manufactured by Beckman Coulter, Inc.), and a volume average particle diameter is set to 5.8 μm.

65 parts of the resin particle dispersion 1 is gently added to the dispersion including the aggregated particles prepared as described above, and a temperature of a heating jacket is further increased and maintained at 53° C. for 1 hour. In a case where the volume average particle diameter of the obtained particles is measured, the value is 6.5 μm.

Next, 1 mol/liter of a sodium hydroxide aqueous solution is added such that the pH becomes 6.0, and then gently heated to 85° C., while continuing the stirring, and maintained for 60 minutes. After that, the heating is performed to 96° C., and 1 mol/liter of a nitric acid aqueous solution is added such that the pH becomes 5.0, and the resultant is maintained for 5 hours. Then, the obtained toner slurry is cooled to 40° C. and the slurry is further sieved with a sieve having an aperture of 30 μm. This is further re-dispersed in ion exchange water, repeatedly filtered, washed such that electric conductivity of the filtrate becomes 20 μS/cm or less, and the resultant is subjected to vacuum-drying in an oven at 40° C. for 5 hours, and thus, toner particles 1 are obtained.

Regarding the obtained toner particles, the molecular weight distribution curve is created by the method described above, and "(c+b)/(2×b)" and the "z average molecular weight Mz" are calculated.

In addition, the "difference (T4−T3) between the endothermic peak temperature T3 of the release agent at the time of first heating of differential scanning calorimetry (DSC) and the endothermic peak temperature T4 of the release agent at the time of second heating", and the "BET specific surface area" are measured by the methods described above.

The results are shown in Table 4.

Preparation of Toner 1

1.5 parts by weight of hydrophobic silica (manufactured by Nippon Aerosil Co. Ltd., RY50) and 1.0 part by weight of hydrophobic titanium oxide (manufactured by Nippon Aerosil Co. Ltd., T805) are mixed with respect to 100 parts by weight of the obtained toner particles 1 using a sample mill at 10,000 rpm for 30 seconds. After that, the mixture is sieved by a vibration sieving device having an aperture of 45 μm, and thus, a toner 1 is obtained.

Preparation of Developer 1

Ferrite particles (average particle diameter of 50 μm): 100 parts

Toluene: 14 parts

A styrene-methyl methacrylate copolymer: (copolymerization ratio: 15/85): 2 parts Carbon black: 0.2 parts The above components excluding the ferrite particles are dispersed by a sand mill to prepare a dispersion, the dispersion and the ferrite particles are put into a vacuum degassing type kneader and dried while stirring under the reduced pressure, and thus, a carrier is obtained.

5 parts of the toner 1 is mixed with 100 parts of the carrier, and thus, a developer 1 is obtained.

Examples 2A to 5A and Comparative Examples 1A to 8A

Toner particles 2 to 13 are produced and developers are produced by the same method as in "Preparation of Resin Particle Dispersion 1" of Example 1, except that the composition of the first addition and the second addition is changed as shown in Table 3.

The measurement results of "(c+d)/(2×d)", the "z average molecular weight Mz", the "difference (T4−T3) between the endothermic peak temperature T3 of the release agent in the first heating of differential scanning calorimetry (DSC) and the endothermic peak temperature T4 of the release agent in the second heating", and the "BET specific surface area" are shown in Table 4.

Comparative Example 9A

A toner and a developer are produced by the same method as that in Example 1, except that the resin particle dispersion 2 prepared below is used as the resin particle dispersion.

Preparation of Resin Particle Dispersion 2

Styrene: 310 parts n-butyl acrylate: 100 parts

β-carboxyethyl acrylate: 9 parts 1,6-hexanediol diacrylate: 3.0 parts

Dodecanethiol: 2.75 part

A solution obtained by dissolving 4 parts of an anionic surfactant (DOWFAX manufactured by The Dow Chemical Company) in 550 parts of ion exchange water is put into a flask, and a mixed solution 2 obtained by mixing the raw materials described above is put thereto and emulsified. While gently stirring the emulsified solution for 10 minutes, 50 parts of ion exchange water where 6 parts of ammonium persulfate is dissolved is put thereto. Then, nitrogen substitution in the system is sufficiently performed, the temperature is increased by oil bath such that the temperature of the inner system becomes 75° C., and polymerization is performed for 5 hours. Accordingly, a resin particle dispersion in which resin particles having a volume average particle diameter of 250 nm are dispersed is obtained. Ion exchange water is added to the resin particle dispersion, the solid content is adjusted to 20% by weight, and thus, the resin particle dispersion 2 is obtained.

The measurement results of "(c+d)/(2×d)", the "z average molecular weight Mz", the "difference (T4−T3) between the endothermic peak temperature T3 of the release agent in the first heating of differential scanning calorimetry (DSC) and the endothermic peak temperature T4 of the release agent in the second heating", and the "BET specific surface area" are shown in Table 4.

The measurement of the values of various physical properties in a case of producing the toner in the examples and the comparative examples described above are performed by the methods described in "Weight Average Molecular Weight Mw of Resin". "Glass Transition Temperature of Resin", and "Volume Average Particle Diameter of Resin Particles and Toner Particles".

Evaluation Test

Evaluation of Difference in Glossiness

A developing unit of "DocuCentre color 400 manufactured by Fuji Xerox Co., Ltd." of an image forming apparatus is filled with each developer obtained in the examples and the comparative examples as described above. By the image forming apparatus, in an environment of a temperature of 35° C. and a humidity of 85% RH, one sheet of the test chart No. 5-1 of The Imaging Society of Japan is printed on thin paper (manufactured by Oji Paper Co., Ltd., plain thin paper CS520 A3T, basis weight of 52 g/m$^2$). After that, the sheet is set as thick paper (manufactured by Fuji Xerox Co., Ltd., OK prince high quality, basis weight of 209 g/m$^2$), 100 sheets are continuously printed, and the printing is performed on one sheet of thin paper (manufactured by Oji Paper Co., Ltd., plain thin paper CS520 A3T, basis weight of 52 g/m$^2$).

Regarding the obtained image on the first thin paper and the image on the thin paper after printing 100 sheets of the thick paper, the measurement of 60 degree glossiness of a half-tone portion of a blue portion (first row from the top portion) and a second color portion of the blue portion (first row from the bottom portion) is performed by a portable glossmeter (BYK GARDNER MICRO-TRI GLOSS METER manufactured by Toyo Seiki Seisaku-Sho).

The printing and the evaluation are repeatedly performed 10 times and an average value is calculated. A difference in glossiness of the half-tone portion of the first thin paper and the half-tone portion of the thin paper after printing of the 100 sheets of the thick paper is evaluated.

A: Difference in glossiness is less than 1.0°

B: Difference in glossiness is 1.0° or more and less than 2.0°

C: Difference in glossiness is 2.0° or more and less than 4.0° C. However, in a level with no practical problems.

D: Difference in glossiness is 4.0° or more

TABLE 3

| | | Composition at preparing resin particle dispersion [parts by weight] | | | | | | | | | |
|---|---|---|---|---|---|---|---|---|---|---|---|
| | | First addition | | | | | Second addition | | | | |
| | | Styrene | n-butyl acrylate | β-carboyethyl acrylate | 1,6-hexanediol diacrylate | Dodecanethiol | Styrene | n-butyl acrylate | β-carboxyethyl acrylate | 1,6-hexanediol diacrylate | Dodecanethiol |
| Example | 1A Toner 1 | 100 | 30 | 3 | 0.5 | 0.75 | 210 | 70 | 6 | 3.5 | 2 |
| | 2A Toner 2 | 100 | 30 | 3 | 0.5 | 1.5 | 210 | 70 | 6 | 5.5 | 3.5 |
| | 3A Toner 3 | 100 | 30 | 3 | 0.5 | 1.5 | 210 | 70 | 6 | 2 | 1.2 |
| | 4A Toner 4 | 100 | 30 | 3 | 0.5 | 0.5 | 210 | 70 | 6 | 5.5 | 3.5 |
| | 5A Toner 5 | 100 | 30 | 3 | 0.5 | 0.5 | 210 | 70 | 6 | 2 | 1.2 |

TABLE 3-continued

| | | Composition at preparing resin particle dispersion [parts by weight] | | | | | | | | | |
|---|---|---|---|---|---|---|---|---|---|---|---|
| | | First addition | | | | | Second addition | | | | |
| | | Styrene | n-butyl acrylate | β-carboyethyl acrylate | 1,6-hexanediol diacrylate | Dodecanethiol | Styrene | n-butyl acrylate | β-carboxyethyl acrylate | 1,6-hexanediol diacrylate | Dodecanethiol |
| Comparative Example | 1A Toner 6 | 100 | 30 | 3 | 0.5 | 1.7 | 210 | 70 | 6 | 5.5 | 3.5 |
| | 2A Toner 7 | 100 | 30 | 3 | 0.5 | 1.7 | 210 | 70 | 6 | 2 | 1.2 |
| | 3A Toner 8 | 100 | 30 | 3 | 0.5 | 0.42 | 210 | 70 | 6 | 5.5 | 3.5 |
| | 4A Toner 9 | 100 | 30 | 3 | 0.5 | 0.12 | 210 | 70 | 6 | 2 | 1.2 |
| | 5A Toner 10 | 100 | 30 | 3 | 0.5 | 1.5 | 210 | 70 | 6 | 5.8 | 3.7 |
| | 6A Toner 11 | 100 | 30 | 3 | 0.5 | 1.5 | 210 | 70 | 6 | 1.8 | 1 |
| | 7A Toner 12 | 100 | 30 | 3 | 0.5 | 0.5 | 210 | 70 | 6 | 5.8 | 3.7 |
| | 8A Toner 13 | 100 | 30 | 3 | 0.5 | 0.5 | 210 | 70 | 6 | 1.8 | 1 |
| | 9A Toner 14 | 310 | 100 | 9 | 3.0 | 2.75 | — | — | — | — | — |

TABLE 4

| | | Expression | | | | Glossiness evaluation result | | | |
|---|---|---|---|---|---|---|---|---|---|
| | | Mz | (A) (c + d)/(2 × d) | BET specific surface area ($m^2/g$) | Release agent [T4-T3] | First sheet | After printing 100 sheets of thick paper | Difference in glossiness | |
| Example | 1A Toner 1 | 200000 | 0.90 | 1.80 | 1.00 | 25.0 | 25.0 | 0.00 | A |
| | 2A Toner 2 | 110000 | 0.77 | 1.80 | 0.80 | 27.0 | 26.0 | 1.00 | B |
| | 3A Toner 3 | 110000 | 0.95 | 1.80 | 0.50 | 27.0 | 26.0 | 1.00 | B |
| | 4A Toner 4 | 390000 | 0.77 | 1.80 | 0.80 | 23.0 | 22.0 | 1.00 | B |
| | 5A Toner 5 | 390000 | 0.95 | 1.80 | 0.50 | 23.0 | 22.0 | 1.00 | B |
| Comparative Example | 1A Toner 6 | 90000 | 0.77 | 1.80 | 0.80 | 23.0 | 27.0 | 4.00 | D |
| | 2A Toner 7 | 90000 | 0.95 | 1.80 | 0.50 | 23.0 | 27.0 | 4.00 | D |
| | 3A Toner 8 | 410000 | 0.77 | 1.80 | 0.80 | 21.0 | 17.0 | 4.00 | D |
| | 4A Toner 9 | 410000 | 0.95 | 1.80 | 0.50 | 21.0 | 17.0 | 4.00 | D |
| | 5A Toner 10 | 110000 | 0.74 | 1.80 | 0.80 | 22.0 | 26.0 | 4.00 | D |
| | 6A Toner 11 | 110000 | 0.96 | 1.80 | 0.50 | 22.0 | 26.0 | 4.00 | D |
| | 7A Toner 12 | 390000 | 0.74 | 1.80 | 0.80 | 20.0 | 24.0 | 4.00 | D |
| | 8A Toner 13 | 390000 | 0.96 | 1.80 | 0.50 | 20.0 | 24.0 | 4.00 | D |
| | 9A Toner 14 | 250000 | 0.98 | 1.80 | 0.50 | 19.0 | 23.0 | 4.00 | D |

From the results, it is found that, in the toner of the examples in which the conditions of the z average molecular weight Mz of 100,000 to 400,000 and "(c+d)/(2×d)" of the molecular weight distribution curve of 0.75 to 0.95 are satisfied, the occurrence of a difference in glossiness occurring on the images before and after repeatedly forming images on the thick paper is prevented, as compared with the toner of the comparative examples in which at least one of the z average molecular weight Mz and "(c+d)/(2×d)" is beyond the ranges described above.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developing toner, comprising:

a styrene-acrylic resin, wherein the electrostatic charge image developing toner exhibits a z average molecular weight Mz of 80,000 to 400,000, and a molecular weight distribution curve satisfying Expression (1):

$$1.3 \leq b/a \leq 2.0 \qquad \text{Expression (1)}$$

(in Expression (1), a represents a width on a high molecular weight side from a perpendicular line at a height which is 50% of a height of a maximum peak, in a case where the perpendicular line is drawn down from the maximum peak of the molecular weight distribution curve, and b represents a width on a high molecular weight side from a perpendicular line at a height which is 15% of a height of the maximum peak, in a case where the perpendicular line is drawn down from the maximum peak of the molecular weight distribution curve).

2. The electrostatic charge image developing toner according to claim 1, wherein the electrostatic charge image developing toner exhibits a number average molecular weight Mn of 7,000 to 25,000, and a ratio (Mz/Mn) of the z average molecular weight Mz to the number average molecular weight Mn of 8 to 25.

3. The electrostatic charge image developing toner according to claim 1, wherein the styrene-acrylic resin is a polymer obtained by polymerizing at least an acrylate monomer including two or more vinyl groups.

4. The electrostatic charge image developing toner according to claim 1, wherein a content of a component insoluble in tetrahydrofuran, excluding a pigment, a release agent, and an external additive in a case of including one or more kinds of additives selected from the pigment, the release agent, and the external additive, is 0.5% by weight to 6% by weight.

5. The electrostatic charge image developing toner according to claim 1, which has a BET specific surface area of 1.5 $m^2/g$ to 2.5 $m^2/g$.

6. The electrostatic charge image developing toner according to claim 1, further comprising:

a release agent, wherein a difference (T2−T1) between an endothermic peak temperature T1 of the release agent at the time of heating of differential scanning calorimetry and an exothermic peak temperature T2 of the release agent at the time of cooling after the heating is from 0° C. to 10° C.

7. An electrostatic charge image developer, comprising:

the electrostatic charge image developing toner according to claim 1.

8. A toner cartridge comprising:

a container that contains the electrostatic charge image developing toner according to claim 1, wherein the toner cartridge is detachable from an image forming apparatus.

9. An electrostatic charge image developing toner comprising:

a styrene-acrylic resin, wherein the electrostatic charge image developing toner exhibits a z average molecular weight Mz is 100,000 to 400,000, and a molecular weight distribution curve satisfying Expression (A):

$$0.75 \leq (c+d)/(2\times d) \leq 0.95 \quad \text{Expression (A)}$$

(in Expression (A), c represents a width on a low molecular weight side from a perpendicular line at a height which is 50% of a height of a maximum peak, in a case where the perpendicular line is drawn down from the maximum peak of the molecular weight distribution curve, and d represents a width on a high molecular weight side from a perpendicular line at a height which is 50% of a height of the maximum peak, in a case where the perpendicular line is drawn down from the maximum peak of the molecular weight distribution curve).

10. The electrostatic charge image developing toner according to claim 9, wherein the styrene-acrylic resin is a polymer obtained by polymerizing at least an acrylate monomer including two or more vinyl groups.

11. The electrostatic charge image developing toner according to claim 9, which has a BET specific surface area of 1.3 $m^2/g$ to 2.5 $m^2/g$.

12. The electrostatic charge image developing toner according to claim 9, further comprising:

a release agent, wherein a difference (T4−T3) between an endothermic peak temperature T3 of the release agent in the first heating of differential scanning calorimetry and an endothermic peak temperature T4 of the release agent in the second heating is from 0° C. to 5° C.

13. An electrostatic charge image developer, comprising:

the electrostatic charge image developing toner according to claim 9.

14. A toner cartridge comprising:

a container that contains the electrostatic charge image developing toner according to claim 9, wherein the toner cartridge is detachable from an image forming apparatus.

* * * * *